US012773036B2

(12) United States Patent
Fadal et al.

(10) Patent No.: US 12,773,036 B2
(45) Date of Patent: Oct. 27, 2026

(54) PORTABLE STORAGE APPARATUS, SYSTEM, AND METHOD

(71) Applicant: Evolution Outdoor LLC, Kilgore, TX (US)

(72) Inventors: Colt Fadal, Kilgore, TX (US); Tyler Fernandes, Irwindale, CA (US); Roger Tan, Chino, CA (US)

( * ) Notice: Subject to any disclaimer, the term of this patent is extended or adjusted under 35 U.S.C. 154(b) by 107 days.

(21) Appl. No.: 17/868,522

(22) Filed: Jul. 19, 2022

(65) Prior Publication Data

US 2023/0027563 A1 Jan. 26, 2023

Related U.S. Application Data

(60) Provisional application No. 63/224,308, filed on Jul. 21, 2021.

(51) Int. Cl.

| | |
|---|---|
| ***A45C 13/10*** | (2006.01) |
| ***A45C 5/02*** | (2006.01) |
| ***A45C 5/06*** | (2006.01) |
| ***A45C 13/00*** | (2006.01) |
| ***A45C 13/02*** | (2006.01) |
| ***A45F 3/02*** | (2006.01) |

(52) U.S. Cl.

CPC ..... *A45C 13/1069* (2013.01); *A45C 5/02* (2013.01); *A45C 5/06* (2013.01); *A45C 13/008* (2013.01); *A45C 13/02* (2013.01); *A45F 3/02* (2013.01)

(58) Field of Classification Search

CPC ..... A45C 13/1069; A45C 5/02; A45C 5/06; A45C 13/008; A45C 13/02; A45F 3/02

See application file for complete search history.

(56) References Cited

U.S. PATENT DOCUMENTS

| | | | |
|---|---|---|---|
| 258,393 | A | 5/1882 | Endicott |
| 1,482,678 | A | 2/1924 | Figley |
| 1,791,346 | A | 2/1931 | Burch et al. |
| D94,404 | S | 1/1935 | Calpha |
| 2,028,339 | A | 1/1936 | Abraham et al. |

(Continued)

FOREIGN PATENT DOCUMENTS

| | | | |
|---|---|---|---|
| CN | 101066048 | A | 11/2007 |
| CN | 101088330 | A | 12/2007 |

(Continued)

OTHER PUBLICATIONS

Plano 3600 and 3700, Joshua Taylor, Aug. 4, 2016, https://www.youtube.com/watch?v=5HW_u8Mhryk, and The Fishing Father, May 30, 2019,https://www.youtube.com/watch?v=yrW4GEsmMUc (Year: 2019).*

(Continued)

*Primary Examiner* — Tri M Mai

(74) *Attorney, Agent, or Firm* — J. Andrew Reed; Think Differently Legal, PLLC

(57) ABSTRACT

A storage apparatus configured for securing, transporting, and accessing storage containers, a method for manufacturing a lid for said storage apparatus, and a storage system. The storage apparatus can include a body and a lid. The lid can include a pad and a skirt connected by a thermoplastic sealing strip. The storage apparatus also may also include a fluid resistant material skirt having at least one dividing wall configured to secure against the walls.

20 Claims, 25 Drawing Sheets

(56) References Cited

U.S. PATENT DOCUMENTS 2,102,977 A 12/1937 Shoemaker et al.
2,316,833 A 4/1943 Baron
2,554,668 A 5/1951 Charles
2,595,463 A 5/1952 Kamps
2,616,209 A 11/1952 Ploen
2,717,470 A 9/1955 Holdeman
2,730,833 A 1/1956 Newell
2,956,365 A 10/1960 Smith et al.
2,987,846 A 6/1961 Powell
3,047,349 A 7/1962 Powell
3,122,225 A 2/1964 Ward
3,122,725 A 2/1964 Romano
3,181,751 A 5/1965 Wilson
RE25,826 E 8/1965 Ward
3,310,271 A 3/1967 King
3,481,066 A 12/1969 Woolworth
3,564,755 A 2/1971 Lindgren, Sr.
3,813,138 A 5/1974 Doohan
3,842,976 A 10/1974 Dea
3,850,396 A 11/1974 Orlandi
3,985,409 A 10/1976 Kneier
4,023,304 A 5/1977 Singer
4,151,938 A 5/1979 Barker et al.
4,169,550 A 10/1979 Williams
4,176,491 A 12/1979 Herring
D257,651 S 12/1980 Katz et al.
4,240,222 A 12/1980 Covington
4,245,422 A 1/1981 Souza
4,324,446 A 4/1982 LeSage
D273,534 S * 4/1984 Weinreb ..... D3/268
D280,260 S 8/1985 Leiserson
D284,333 S 6/1986 Huston
D284,620 S 7/1986 Calton
D291,149 S 8/1987 Smith
4,739,886 A 4/1988 Seaberg
4,769,941 A 9/1988 Schmidt
D299,587 S 1/1989 Thomas
4,811,996 A 3/1989 Hansson
4,854,432 A 8/1989 Carpenter et al.
4,958,730 A 9/1990 Bunten
D311,452 S 10/1990 Ehret
D312,530 S 12/1990 Gallen et al.
5,054,669 A 10/1991 Zimbardi et al.
5,087,105 A 2/1992 White
D333,038 S 2/1993 Collins
D336,218 S 6/1993 Hague
5,217,119 A 6/1993 Hollingsworth
D341,026 S 11/1993 Barker
5,261,529 A 11/1993 Holland
D347,521 S 6/1994 Elliott
D349,191 S 8/1994 Mason
D352,827 S 11/1994 Schildkraut
5,386,662 A 2/1995 Vader et al.
D360,182 S 7/1995 Lovett
5,454,477 A 10/1995 Bornhorst et al.
D368,370 S 4/1996 Tawil
5,505,297 A 4/1996 Myers
D371,051 S 6/1996 Melk
D371,052 S 6/1996 Melk
5,526,907 A 6/1996 Trawick
5,526,927 A 6/1996 McLemore
D371,724 S 7/1996 Melk
5,556,068 A 9/1996 Gorelik
D376,044 S 12/1996 Trawick et al.
5,606,820 A 3/1997 Suddeth
D381,871 S 8/1997 Melk
D382,108 S 8/1997 Wheeler
D383,601 S 9/1997 Jones et al.
5,676,223 A 10/1997 Cunningham
D387,626 S 12/1997 Melk
D389,305 S 1/1998 Hauschild
D394,552 S 5/1998 Melk
5,762,170 A 6/1998 Shyr et al.
5,769,260 A 6/1998 Killinger et al.
5,772,066 A 6/1998 Reynolds
D396,745 S 8/1998 Peterson
D398,083 S 9/1998 Martz
D401,062 S 11/1998 Hauschild
5,829,185 A 11/1998 Myers
5,908,147 A 6/1999 Chuang
D412,269 S 7/1999 Wyant
D414,932 S 10/1999 Platte, III
D416,680 S 11/1999 Latshaw
6,053,317 A * 4/2000 Morris ..... B65D 81/3886 206/588
D423,779 S 5/2000 Goatcher
D427,768 S 7/2000 Bogert
D434,901 S 12/2000 Eskandry
D435,343 S 12/2000 Eskandry
D435,863 S 1/2001 Eskandry
D439,047 S 3/2001 Holland et al.
6,202,865 B1 3/2001 Kuo
6,202,910 B1 3/2001 Swetish
6,290,040 B1 9/2001 Chen
6,321,912 B1 11/2001 Lippert et al.
D452,806 S 1/2002 King
6,454,097 B1 9/2002 Blanco
D465,086 S 11/2002 Watts
D465,134 S 11/2002 Joss
D468,101 S 1/2003 Hassett
D469,606 S 2/2003 Su
6,516,927 B2 2/2003 Krulik
D471,012 S 3/2003 Peterson
6,530,475 B1 3/2003 Penney
D472,380 S 4/2003 Hillman
D472,386 S 4/2003 Bauer
D474,598 S 5/2003 Platte, III
D476,480 S 7/2003 Hillman
6,595,604 B1 7/2003 Peterson
6,612,434 B1 9/2003 Redzisz
D481,204 S 10/2003 Rada
D482,525 S 11/2003 Fair
D482,842 S 12/2003 Fair
D484,695 S 1/2004 DePalma
D485,144 S 1/2004 Levine et al.
D487,189 S 3/2004 Ukitsu et al.
D487,191 S 3/2004 Ong
D492,160 S 6/2004 Lanman et al.
6,742,636 B2 6/2004 Godshaw
D495,489 S 9/2004 Messina-Brown
6,821,019 B2 * 11/2004 Mogil ..... A45C 13/02 383/110
D500,923 S 1/2005 Gonzalez et al.
D504,229 S 4/2005 Duvigneau
D506,061 S 6/2005 McGibben
D507,734 S 7/2005 Willems
6,926,136 B1 8/2005 Lynch-Bass
D514,317 S 2/2006 Conforti
D528,295 S 9/2006 Harvey
D530,089 S 10/2006 Silverman
7,162,890 B2 1/2007 Mogil et al.
D542,031 S 5/2007 Zapata
D542,527 S 5/2007 Zapata
7,240,513 B1 7/2007 Conforti
D552,350 S 10/2007 Bosley
D556,452 S 12/2007 Hydon
D560,450 S 1/2008 Tagliati et al.
D566,393 S 4/2008 Kidakarn
D574,615 S 8/2008 Picot et al.
7,467,695 B2 12/2008 Gormick et al.
D584,046 S 1/2009 Montague
7,568,566 B2 * 8/2009 D'Ambrosio ..... E05C 19/161 206/315.3
7,604,103 B2 10/2009 Hamlin
D603,169 S 11/2009 Smith
7,621,074 B2 11/2009 Glidewell et al.
7,699,083 B1 * 4/2010 Kim ..... A63B 60/62 150/160
D620,254 S 7/2010 Noraker
7,837,032 B2 * 11/2010 Smeltzer ..... A63B 55/00 190/902
D634,543 S 3/2011 Scicluna et al.
D634,601 S 3/2011 Good
7,937,884 B1 5/2011 Naylor et al.

(56) References Cited

U.S. PATENT DOCUMENTS 7,941,965 B2 5/2011 Hoover
D639,051 S 6/2011 Dare
D647,301 S 10/2011 Sosnovsky
8,043,004 B2 10/2011 Mogil
D648,533 S 11/2011 Sosnovsky
D660,589 S 5/2012 Ayjian
D663,944 S 7/2012 Bouskill
8,327,659 B2 12/2012 Winkler et al.
8,348,510 B2 1/2013 Mogil
D676,652 S 2/2013 Holloway et al.
8,453,813 B2 6/2013 Lai
D692,661 S 11/2013 Gupton
D692,662 S 11/2013 Pignotti
8,621,720 B2 1/2014 Kao et al.
D714,541 S 10/2014 Anderson et al.
D720,216 S 12/2014 Luburic et al.
8,899,071 B2 * 12/2014 Mogil ..... A45C 11/20 62/457.7
D724,318 S 3/2015 Myer
D725,908 S 4/2015 Zwetzig
D739,653 S 9/2015 Majeau et al.
9,144,281 B2 9/2015 Cross
D742,637 S 11/2015 Miles
9,226,557 B2 1/2016 Sullivan
D748,918 S 2/2016 Majeau
D761,564 S 7/2016 Rhodes
D762,384 S 8/2016 Boroski
D762,978 S 8/2016 Boroski
9,462,874 B1 10/2016 Samuel
D779,824 S 2/2017 Boroski
D781,575 S 3/2017 Etekochay
D787,816 S 5/2017 Slimane
D793,728 S 8/2017 Faibish et al.
D796,188 S 9/2017 Ho et al.
D802,913 S 11/2017 Tien
9,854,897 B1 1/2018 Pelkey, Jr. et al.
D811,727 S 3/2018 Quehl et al.
D818,204 S 5/2018 Renforth
D821,097 S 6/2018 Burton et al.
D824,170 S 7/2018 Tobias
D831,952 S 10/2018 Pennington
D832,653 S 11/2018 Waskow et al.
D833,141 S 11/2018 Carter et al.
D835,473 S 12/2018 Jacobsen
D835,950 S 12/2018 Jacobsen
10,143,282 B2 12/2018 Seiders et al.
D836,999 S 1/2019 Jacobsen
D837,000 S 1/2019 Jacobsen
D837,001 S 1/2019 Jacobsen
D838,971 S 1/2019 Deanda
10,188,186 B2 * 1/2019 Norman ..... A45C 11/00
D843,107 S 3/2019 Swaggart
D844,324 S 4/2019 Hoppe et al.
D845,613 S 4/2019 Decker
D849,398 S 5/2019 Tan
D856,662 S 8/2019 Breines
D862,528 S 10/2019 Sullivan et al.
10,477,991 B1 11/2019 Fragala
D873,090 S 1/2020 Jacobsen
D874,129 S 2/2020 Goldstein
D875,385 S 2/2020 Carter et al.
D880,253 S 4/2020 Jacobsen
D881,655 S 4/2020 Jacobsen
D887,135 S 6/2020 Tan
D887,136 S 6/2020 Tan
D888,413 S 6/2020 Dai
D889,821 S 7/2020 Xu
D890,517 S 7/2020 Smith
D893,183 S 8/2020 Eisenhardt et al.
D896,504 S 9/2020 Li
D896,505 S 9/2020 Yuan
D896,514 S 9/2020 Tan
D898,349 S 10/2020 He
D899,079 S 10/2020 Priest
D901,882 S 11/2020 Tan
10,881,178 B2 1/2021 Johnson
D912,974 S 3/2021 Breines
D915,762 S 4/2021 Li
D915,770 S 4/2021 Breines
10,973,206 B2 4/2021 Friedgood et al.
D919,287 S 5/2021 He
D920,744 S 6/2021 Eisenhardt et al.
D922,061 S 6/2021 Tan
D922,062 S 6/2021 Shi
D927,174 S 8/2021 Dai
D927,261 S 8/2021 Rong
11,076,666 B2 * 8/2021 Sullivan ..... A45C 13/008
D930,360 S 9/2021 Cai
D931,600 S 9/2021 Huang
11,116,297 B1 9/2021 Latham et al.
D932,179 S 10/2021 Mukri
D938,716 S 12/2021 Tan
D938,717 S 12/2021 Tan
D938,722 S 12/2021 Tan
D939,209 S 12/2021 Tan
D941,577 S 1/2022 Fernandes
D941,578 S 1/2022 Fernandes
D944,004 S 2/2022 Tan
D944,008 S 2/2022 Tan
11,242,189 B2 * 2/2022 Rogers ..... B65D 81/3897
D947,524 S 4/2022 Tan
D964,021 S 9/2022 Wu
D964,123 S 9/2022 Peng
D979,244 S 2/2023 Luo
11,673,344 B2 * 6/2023 Chen ..... B65D 81/3813 220/592.16
2001/0042665 A1 11/2001 Siwak
2002/0181806 A1 12/2002 Godshaw et al.
2003/0234269 A1 12/2003 Shamas
2004/0065573 A1 4/2004 Brouard
2004/0149600 A1 8/2004 Wolter et al.
2005/0016648 A1 * 1/2005 Vakharia ..... A63B 60/62 150/160
2005/0077135 A1 4/2005 Drew et al.
2005/0082132 A1 4/2005 Smith
2005/0121275 A1 6/2005 Platte
2005/0161483 A1 7/2005 Krohn
2005/0263364 A1 12/2005 Sher
2005/0263527 A1 12/2005 Maldonado et al.
2005/0279124 A1 12/2005 Maldonado
2006/0064852 A1 3/2006 Willems
2007/0011939 A1 1/2007 Sakai
2007/0214613 A1 * 9/2007 Shiao ..... A63B 55/00 24/303
2007/0226966 A1 10/2007 Tominaga
2007/0228097 A1 * 10/2007 Recanati ..... B60R 7/043 190/110
2007/0237432 A1 10/2007 Mogil
2007/0245521 A1 10/2007 Chehebar
2007/0261977 A1 * 11/2007 Sakai ..... A01K 97/06 206/315.11
2008/0029666 A1 2/2008 Hurt
2008/0116026 A1 5/2008 Bass et al.
2008/0121554 A1 5/2008 Townsend
2008/0164265 A1 7/2008 Conforti
2008/0289925 A1 11/2008 Sapyta
2009/0052809 A1 2/2009 Sampson
2009/0261600 A1 * 10/2009 D'Ambrosio ..... A45C 13/1069 292/251.5
2009/0294237 A1 12/2009 Sisitsky
2009/0301911 A1 12/2009 Rubin
2012/0043228 A1 2/2012 Ezzo et al.
2012/0286011 A1 11/2012 Wegener
2013/0043293 A1 2/2013 Connell
2013/0068776 A1 3/2013 Patterson
2013/0145581 A1 6/2013 Bailey
2014/0132131 A1 5/2014 Thomas
2014/0290025 A1 10/2014 Custer
2014/0360831 A1 12/2014 Kao
2015/0014108 A1 1/2015 Vecellio
2015/0101958 A1 4/2015 Cross
2016/0105050 A1 * 4/2016 Chan ..... H02J 7/00 361/752
2016/0187046 A1 6/2016 Chen et al.

(56) References Cited

U.S. PATENT DOCUMENTS

| | | | | |
|---|---|---|---|---|
| 2016/0205913 | A1 | 7/2016 | Aston et al. | |
| 2016/0244239 | A1 | 8/2016 | Nash | |
| 2016/0374440 | A1 | 12/2016 | Lundy et al. | |
| 2017/0073146 | A1 | 3/2017 | Kuhn et al. | |
| 2017/0119121 | A1* | 5/2017 | Munoz | A45F 3/04 |
| 2017/0343247 | A1 | 11/2017 | Ahmad et al. | |
| 2018/0220759 | A1 | 8/2018 | Johnson | |
| 2018/0252458 | A1 | 9/2018 | Furneaux et al. | |
| 2018/0263346 | A1 | 9/2018 | Stephens | |
| 2018/0343995 | A1 | 12/2018 | Dingler et al. | |
| 2019/0200715 | A1 | 7/2019 | Peris et al. | |
| 2019/0216193 | A1 | 7/2019 | Kabalin | |
| 2019/0234684 | A1 | 8/2019 | Kabalin | |
| 2020/0077760 | A1 | 3/2020 | Grill et al. | |
| 2020/0205537 | A1 | 7/2020 | Franco | |
| 2020/0228056 | A1 | 7/2020 | Miller | |
| 2021/0007451 | A1 | 1/2021 | Tan | |
| 2021/0007452 | A1 | 1/2021 | Tan | |
| 2021/0009313 | A1 | 1/2021 | Tan | |
| 2021/0068510 | A1 | 3/2021 | Johnson | |
| 2021/0212442 | A1 | 7/2021 | Webb | |
| 2021/0262724 | A1 | 8/2021 | Chen | |
| 2021/0368955 | A1 | 12/2021 | Fernandes | |
| 2023/0027563 | A1 | 1/2023 | Fadal et al. | |
| 2023/0232952 | A1 | 7/2023 | Zucco | |

FOREIGN PATENT DOCUMENTS

| | | | | | |
|---|---|---|---|---|---|
| CN | 201360487 | Y | | 12/2009 | |
| CN | 101786524 | A | | 7/2010 | |
| CN | 102972367 | A | | 3/2013 | |
| CN | 205357836 | U | | 7/2016 | |
| CN | 206502215 | U | | 9/2017 | |
| CN | 104925344 | B | | 9/2018 | |
| EP | 0071274 | A2 | | 2/1983 | |
| EP | 3071274 | A1 | | 9/2016 | |
| JP | H07241210 | A | | 9/1995 | |
| JP | D1128650 | | | 12/2001 | |
| JP | 2002240868 | A | | 8/2002 | |
| JP | 2006204116 | A | * | 8/2006 | |
| KR | 20150043946 | A | * | 4/2015 | A01K 97/06 |
| WO | WO-2019227267 | A1 | * | 12/2019 | B29C 65/18 |

OTHER PUBLICATIONS 5.11 Tactical 56298-092-1SZ-UCR 13.7L Storm Tactical Sling Bag; unknown first available date, recreationid.com [online], [site visited Nov. 24, 2020], Available from internet U RL:https://www.recreationid.com/511tactical/ucr-13-7-I-storm-tactical-sling-bag-mpn-56298-092-1-sz.html (Year: 2020).

5007 Flambeau Pro-Angler Sling Pack (Kinetic Blue), unknown first available date, evolutionoutdoor.com [online], [site visited Nov. 24, 2020], Available from internet U RL:https://evolutionoutdoor.com/products/5007-flambeau-pro-angler-sling-pack-kinetic-blue?variant=35241408331932 (Year: 2020.

Academy, "H2O Xpress Pro Tackle Bag II," on sale at least as of Apr. 1, 2022 (https://www.academy.com/p/h2o-xpress-pro-tackle-bag-ii?sku=blue ) (Year: 2022).

Amazon, "Evolution Outdoor Design Large Mouth Double Decker Mossy Oak Tackle Backpack 3600 Manta Grey Camo Evolution", Date first listed on Amazon Sep. 14, 2017. (https://www.amazon .com/Evolution-Outdoor-Design-Backpack-Fishing/dp/B07PJWZXHY) (Year: 2017).

Amazon, "Flambeau 4007 Heritage Tackle Bag, Fir Green/Pewter/Rust, FL40001", First on sale Apr. 23, 2020. (https://www.amazon.com/Fiambeau-Heritage-Bait-Binder/dp/B089469PPT) (Year: 2020).

Amazon, "Piscifun Fishing Tackle Backpack with 4 Trays Large Waterproof Tackle Bag Storage . . . ", (https://www .amazon .com/Piscifun-Backpack-Capacity-Waterproof-Protective/dp/B07CGJ DTN GI} (Year: 2018), 13 pgs.

Amazon, "Westfield Fishing Tackle Bag Water Resistant Soft Sided Waist Shoulder Carry Storage Hiking Climbing Fly," on sale at least as of Apr. 1, 2022 (https://www.amazon.co.uk/Westfield-Fishing-Resistant-Shoulder-Climbing/dp/B01H6WE47Y) (Year: 2022).

Amazon/Pascifun—Amazon "Piscifun Fishing Tackle Backpack"—As early as Jun. 2, 2018.

Bass Pro Shops, "Bass Pro Shops Advanced Anglers Il Large Tackle System," on sale at least as of 204-01-2022, (https://www.basspro.com/shop/en/bass-pro-shops-advanced-anglers-ii-large-tackle-system) (Year: 2022).

Bass Pro Shops, "Cabela's Extreme Wide-Top Tackle Bag," on sale at least as of Apr. 1, 2022 (https://www.basspro.com/shop/en/cabelas-extreme-wide-top-3600-tackle-bag) (Year: 2022).

Bass Pro Shops, "Plano B-Series 3600 Tackle Bag," on sale at least as of Apr. 1, 2022 (https://www.basspro.com/shop/en/plano-b-series-3600-tackle-bag) (Year: 2022).

Evolution Outdoor Drift Series Topless Horizontal Tackle Bag, first available Feb. 24, 2021, amazon.com [online], [site visited Jun. 28, 2021], Available at internet URL: https://www.amazon.com/Evolution-Outdoor-Topless-Horizontal-Tackle/dp/B08WRNXBXV?th=1&psc=1 (Year: 2021).

Evolution Outdoor Drift Series Topless Vertical Tackle Bag, first available Mar. 2, 2021, amazon.com [online], [site visited Jun. 28, 2021], Available at internet URL: https://www.amazon.com/Evolution-Outdoor-Topless-Vertical-Tackle/dp/B08WRVCF31?th=1 (Year: 2021).

Flambeau 5007 Pro-Angler Tackle Bag (Grey/Red), first available Apr. 23, 2020, amazon.com [online], [site visited Nov. 24, 2020], w Available from internet U Rl: https://www.arnazon .corn/Fiarnbeau-5007 -Pro-Angler-Tackle-Grey/dp/B089458PL7 /ref=sr _1_22?dchild=1&gclid=EAiaiQobCh M 10uut0b6b 7QIVCDiGC% E2%80%A6 (Year: 2020).

Flambeau Heritage 4007 Tackle Bag, unknown first available date, DicksSportingGoods.com [online], [site visited Nov. 24, 2020], Available from internet U RL: https://www.dickssportinggoods.com/p/flambeau-heritage-4007-tackle-bag-20fmbaflmbhrtg3 70tbx/20fmbaflmbhrtg370tbx?sku=21521402&camp=CSE:%E2%80%A6 (Year: 2020).

International Search Report and Written Opinion dated May 19, 2017 of PCT Application No. PCT/US2016/047971, 14 pages.

KastKing Fishing Tackle Bag, first available Jun. 27, 2018, amazon.com [online], [site visited Jun. 28, 2021], Available at internet URL: https://www.amazon.com/KastKing-Saltwater-Waterproof-Medium-Hoss-15x11x10-25/dp/B07XRFSFPN/ref=pd_Ipo_3?pd_rd_i=B07F2GH9VS&psc=1 (Year: 2018).

KastKing Fishing Tackle Bags, first available Jun. 27, 2018, amazon.com [online], [site visited Nov. 14, 2018], Available from internet U R L: https : 1/www .amazon. com/d p/BO7F2HV28F/ref=sspa_dk_ detail_6?bd_rd_i=BO7XRFSFPN&pd_rd_w=a6HTH&pf_rd_p7d37a48b-2b1a-4373-8c1a-bd%E2%80%A6 (Year: 2018).

Okuma Fishing Tackle Soft Sided Tackle Bag, first available Oct. 23, 2015, amazon.com [online], [site visited Nov. 24, 2020], Available from internet U RL: https://www.arnazon.com/Okurna-Fishing-Tackle-Soft-Sided/dp/B018M56S28 (Year: 2015).

Ozark Trail Outdoor Equipment "Mesh Bottom Tackle Bag", 6 pgs.

Plano Guide Series Tackle Bag, first available Feb. 10, 2020, amazon.com [online], [site visited Jun. 28, 2021], Available at internet URL: https://www.amazon.com/Piano-Premium-Storage-included-PLABG371/dp/B084NQLFMH/ref=pd_Ipo_2?pd_rd_i=B084NQLFMH&psc=1 (Year: 2020).

Reebow Gear Tactical Sling Bag . . . , first available Jan. 7, 2018, amazon.com [online], [site visited Nov. 24, 2020], Available frominternet U RL: https://www.amazon .com/Tacticai-Siing-Military-Shoulder-Backpack/dp/B0768G7H9N?h= 1 (Year: 2018).

Walmart—Ozark Trail Outdoor Equipment "Mesh Bottom Tackle Bag"—As early as 2019.

Walmart, "Ozark Trail 370 Large Pro Quick Access Soft Sided Fishing Tackle Bag", on sale at least as of Apr. 1, 2022. (https://www.walmart.com/ip/Ozark-Trail-370-Large-Pro-Quick-Access-Soft-Sided-Fishing-Tackle-Bag-Black/474776073 ) (Year: 2022).

U.S. Appl. No. 29/777,817, filed Apr. 8, 2021, Tyler Fernandes.

U.S. Appl. No. 29/800,528, filed Jul. 21, 2021, Colt Fadal.

U.S. Appl. No. 29/800,529, filed Jul. 21, 2021, Colt Fadal.

U.S. Appl. No. 29/800,531, filed Jul. 21, 2021, Colt Fadal.

(56) References Cited

OTHER PUBLICATIONS

U.S. Appl. No. 29/823,195, filed Jan. 14, 2022, Tyler Fernandes.
U.S. Appl. No. 29/823,196, filed Jan. 14, 2022, Tyler Fernandes.
Plano A-Series 2.0 Quick Top, unknown first available date, planomolding.com [online], [site visited Jan. 9, 2023], Available at URL: https://planomolding.com/products/aseries-20-quick-top-plaba700?variant=4046805427 8304 (Year: 2023).
Plano Guide Series 3600 Tackle Bag, unknown first available date, tacklecove.com [online], [site visited Jan. 9, 2023], Available at URL:https://www.tacklecove.com/store/p/496-Plano-Guide-Series-3600-Tackle-Bag.aspx (Year: 2023).

* cited by examiner

PORTABLE STORAGE APPARATUS, SYSTEM, AND METHOD

CROSS-REFERENCE TO RELATED APPLICATIONS

This application is related to U.S. patent application Ser. No. 17/059,526, filed on Nov. 30, 2020, which is a national phase application of International Patent Application No. PCT/CN2018/088627, filed on May 28, 2018, the disclosures of which are incorporated herein by reference.

This present disclosure claims priority to U.S. Provisional Patent Application No. 63/224,308, filed Jul. 21, 2021, which is incorporated herein by reference in its entirety for all purposes.

TECHNICAL FIELD

The present disclosure relates to portable storage devices. More particularly, and not by way of limitation, the present disclosure is directed to an apparatus for magnetically sealed portable storage devices for sporting goods, a method for manufacturing a lid for a storage apparatus, and a storage system.

BACKGROUND

Bags are a convenient way to carry large or small items. Bags can have handles so that they can be carried by hand, or straps that allow the bags to be carried on a user's body. For example, slings or backpacks have straps that allow the bag to be carried on a user's shoulders. Likewise, a fanny pack has a strap that allows the bag to be carried around a user's waist. Bags may be secured shut by a variety of closing mechanisms. Zippers, magnets, buttons, clasps, among others secure the contents inside the bag.

Bags can be specially configured for specialized use cases. For example, tackle boxes are designed to allow a user to carry tucked gear, food, and/or clothing. Bags may be constructed from a variety of materials, each having benefits and drawbacks. Bags face additional challenges when exposed to harsh environments. Bags designed for saltwater exposure must account for immediate water intrusion, standing water that might seep into the bag, and the long-term chemical effects.

BRIEF SUMMARY

The present disclosure provides an improved storage apparatus for securing, transporting, and accessing storage containers, a method for manufacturing a lid for a storage apparatus, and a storage system.

In at least one example, the storage apparatus contains a body and a lid. The body contains a body void for storing storage containers. The lid is made up of a hard plastic pad and a soft thermoplastic skirt, connected to one another by a thermoplastic sealing strip. This strip can be sewn or welded to the bottom edges of the pad and is heat welded to the top edges of the skirt.

In yet other examples, the method for manufacturing a lid for a storage apparatus contains the following steps: providing a soft thermoplastic skirt, which has a front wall, a rear wall, and opposing side walls that connect the front wall to the rear wall; forming a rigid plastic pad that will connect to the soft thermoplastic skirt; connecting the rigid plastic pad to the soft thermoplastic skirt via a thermoplastic sealing strip, which connecting step can be accomplished by heat welding a first edge of the thermoplastic sealing strip to the top edges of the skirt front, rear, and side walls and sewing a second edge of the thermoplastic sealing strip to the bottom edges of the pad; sealing a body with the lid by enveloping the outer edge of the body with the lid. The body is defined by a front wall, a rear wall, a first side wall, a second side wall, and a bottom wall. Furthermore, the body front, rear, and side walls each comprise soft thermoplastic.

In still further examples, the storage system contains at least one dividing wall and a storage apparatus configured to removably couple the at least one dividing wall. The at least one dividing wall defines a wall, a first edge, and a second edge. The storage apparatus contains a body and a lid. The body contains a body void for coupling the at least one dividing wall. Each dividing wall edge couples to opposing sides of the body void by a securing mechanism. The lid is made up of a hard plastic pad and a soft thermoplastic skirt, connected to one another by a thermoplastic sealing strip. This strip is sewn or welded to the bottom edges of the pad and is heat welded to the top edges of the skirt.

BRIEF DESCRIPTION OF THE DRAWINGS

For a fuller understanding provided by the disclosure, reference should be made to the following detailed description together with the accompanying drawings wherein.

and

Figure 15:
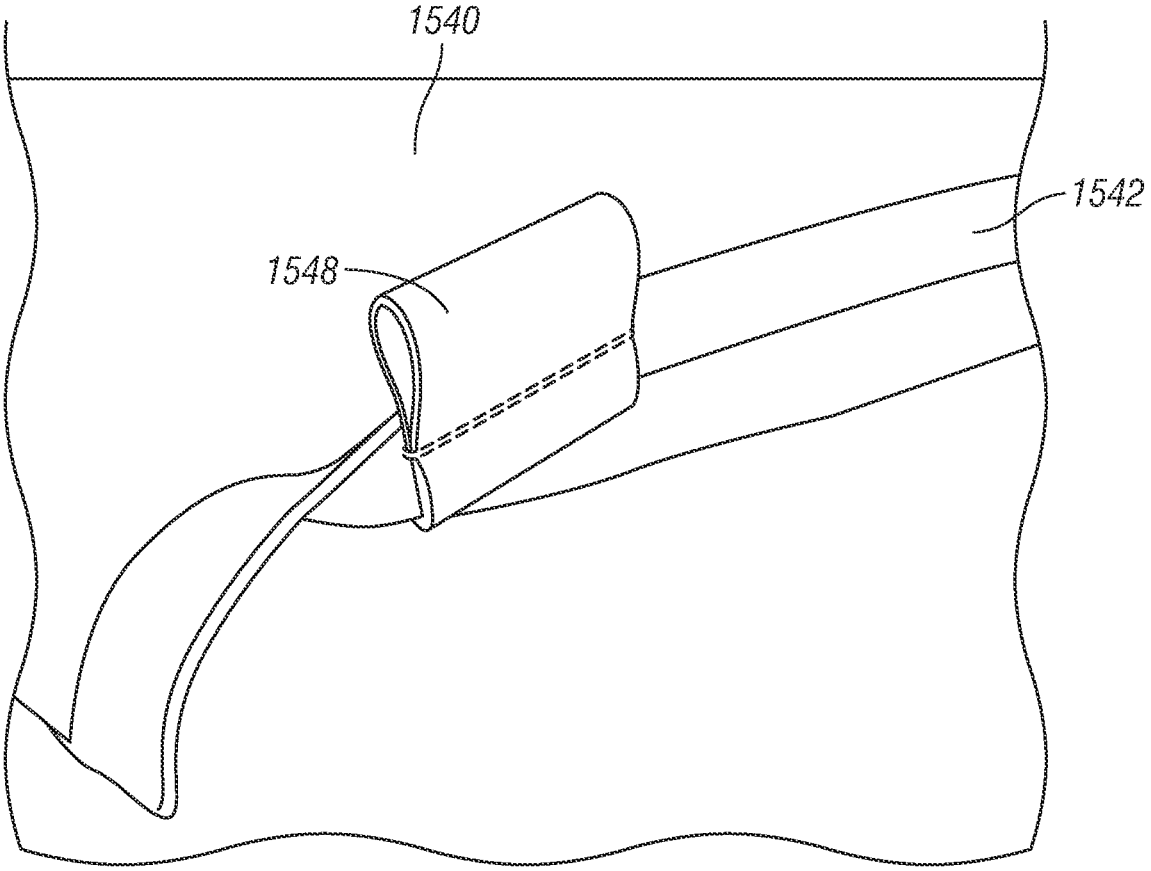

FIG. 15 is an illustration of a close-up view of welded loops of a storage apparatus.

DETAILED DESCRIPTION

Embodiments of the disclosure will now be described. The various embodiments of the presently disclosed subject matter are described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies. The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the preferred embodiments, terminology will be resorted to for the sake of clarity. It is intended that each term contemplates its broadest meaning as understood by those skilled in the art and includes all technical equivalents, which operate in a similar manner to accomplish a similar purpose.

Also, the use of terms herein such as "having," "has," "including," or "includes" are open-ended and are intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order, among or between various steps herein disclosed unless and except when the order of individual steps is explicitly required.

Bags can be comprised of a variety of materials with different properties. As portable storage apparatuses, bags need to be durable and sturdy while maintaining a light weight. One way of meeting these traits involves combining soft thermoplastic materials with rigid plastic materials. To preserve the structure of the bag, the soft thermoplastics are sewn onto the rigid plastic materials. This manufacturing approach causes issues for bags designed for exposure to water. When sewn, soft thermoplastics and rigid plastics tend to lose water impermeable traits because the materials are punctured to allow for stitching. This issue is more pronounced in saltwater environments because of the more damaging effects of the intruding water. Saltwater corrodes metal much faster than fresh water due to the sodium chloride in the water. Bags designed for saltwater exposure must account for these corrosive effects.

A bag designed for water exposure must also maintain a water impermeable seal around the lid to protect the contents inside. Bags may be closed with a variety of closing mechanisms, each having different properties and tradeoffs between ease-of-use and effective sealing. A bag designed for water exposure must maintain as effective of a seal as possible while also providing ease-of-use. Magnets can be a powerful closing mechanism that also maintain ease-of-use when a user opens and closes the bag. The magnetic adherence caused by two magnets aligning to each other can be harnessed to provide a force to keep a bag closed. In addition, magnets may be embedded within an enclosed section while maintain their potence as a securing mechanism. This is because the magnets' magnetic field extends through most materials. This permits the magnets to be protected from external environment exposure. This approach faces challenges if the magnets are not secured in a fixed position, because they will slide around within the material, making it more difficult for the two magnets to align.

Figure 1A:
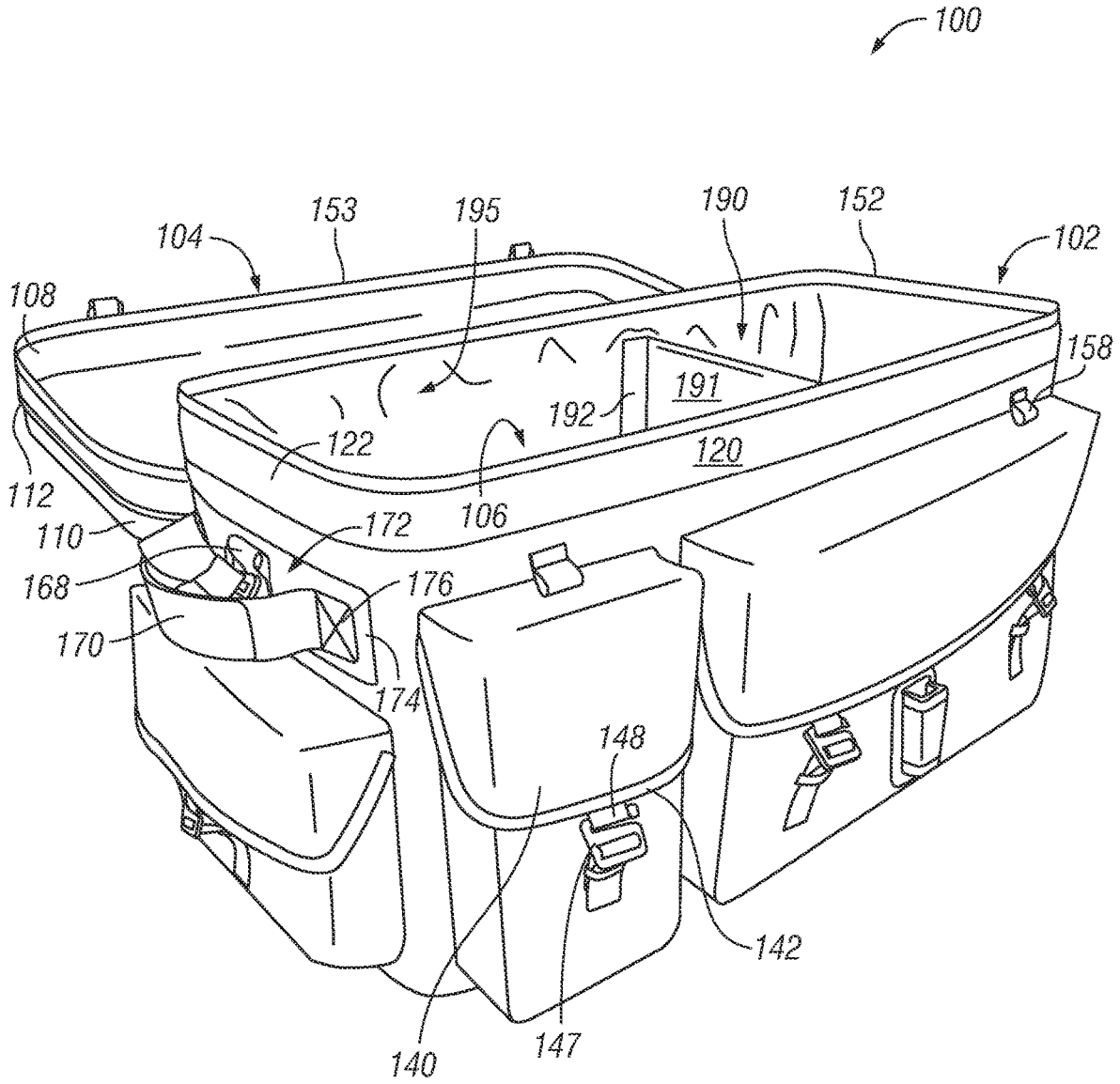
FIG. 1A is an illustration of a front perspective view of a storage apparatus with a lid in an open position.

FIG. 1A is an illustration of a front view of a storage apparatus 100 with a lid in an opened position. The storage apparatus 100, in at least one example, can be utilized for storage of equipment or devices in a corrosive environment. The corrosive environment can be in areas that are near or on saltwater. In other examples, the storage apparatus 100 can be utilized in non-corrosive environments. The components that comprise the storage apparatus 100 allow for the sealing and/or securing of a body 102 and a lid 104.

The storage apparatus 100, can be comprised of a body 102 and a lid 104. The body 102 may include a body void 106 that can be closed when the lid 104 is placed on top of the body 102. In at least one embodiment, the body void 106 and the lid 104 engage to form a friction fit connection. In at least one example, the lid 104 is connected to the body 102 by a removable connection, such as a disconnecting hinge. In some examples, the disconnecting hinge can comprise snaps or a zipper. The lid 104 and/or the body 102 and the securing mechanism can be coupled together through a stitching or other connection type such as glue, magnets, buttons, snaps, or a combination thereof, or other connection types.

In at least one embodiment, the lid 104 forms a seal with the body 102 when they are engaged together. The body 102 is defined by a front wall 120, a rear wall (See FIG. 1B), a first side wall 122, a second side wall (See FIG. 1E), and a bottom wall (See FIG. 6A). These walls define a body void 106. The body may be formed out of a soft material, such as a soft thermoplastic, a rigid material, or a combination thereof. The lid 104 seals the body 102 by enveloping the outer edge of the body with the lid.

The lid 104 of the storage apparatus 100 can be comprised of a skirt 108 and a pad 110. The skirt of the lid may include a front wall (See FIG. 1C), a rear wall (See FIG. 1B), and opposing side walls (See FIG. 1C) and (See FIG. 1E) connecting the front wall to the rear wall. The skirt 108 may be manufactured from a soft thermoplastic having fluid resistant properties. As used herein, the term "soft" means the lack of stiffness or rigidity of a material is such that the material yields readily to touch or pressure, and its shape may be distorted in response to forces applied to it. For example, the skirt 108 may be manufactured from a soft thermoplastic such as thermoplastic polyurethane (TPU) or thermoplastic polyolefin (TPO) or other thermoplastics such as polypropylene, polyethylene, and polybutylene. Other materials that may be employed could also include polyvinyl chloride (PVC), chlorosulfonated polyethylene (CSPE or CSM), chlorinated polyethylene (CPE), and ethylene propylene diene terpolymer (EPDM). The skirt 108 when engaged with the body 102 can create a fluid or liquid resistant seal, and in at least one example a water or liquid proof seal.

The pad 110 of the lid 104 can be constructed with a rigid plastic. As used herein, the term "rigid" means a tendency to maintain its shape when minimal forces are applied, such as the weight of the storage apparatus 100, and such that the material tends to return to its original shape if the force applied is high enough to deform the material but not so high as to surpass the elastic limit of the material. For example, the pad 110 may be manufactured from an elastic co-polymer such as Ethylene-Vinyl Acetate (EVA) or a hard co-polymer such as Acrylonitrile Butadiene Styrene (ABS). EVA is very similar to rubber and provides cushion, spring (rebound), and is resistant to hardening and cracking. It also resists ultraviolet (UV) radiation, does not absorb water, and stays flexible in the cold, all of which make it very useful as a material for bags. ABS is very structurally sturdy, inexpensive, strong, stiff, and holds up well to external impacts. It also has strong resistance to corrosive chemicals. It is very easy to machine and has a low melting temperature making it particularly simple to use in injection molding manufacturing processes. In at least one example, the pad 110 can be designed to a have grooves or ridges that allow for liquid to be drained from the pad 110.

The pad 110 may be connected to the skirt 108 via a thermoplastic sealing strip 112 as more fully described in reference to FIG. 3 below. The thermoplastic sealing strip 112 can be sewn or welded to bottom edges of the pad 110 and may be heat welded to the top edges of the skirt front, rear, and side walls. In at least one example, all interfaces between surfaces are welded to allow for increased water or liquid resistance. In addition, in advantageous examples, the thermoplastic sealing strip 112 may include waterproofing characteristics, such as the flexibility of rubber or elastomer materials to create a seal. In such examples, although the sealing strip 112 may be at least partially sewn or welded, and thus pierced or sealed, the elastic characteristics of the material (such as the softness and flexibility) comprising the thermoplastic sealing strip 112 can still substantially seal around the piercings and thread material caused by being sewn to another material.

In at least one embodiment, the thermoplastic sealing strip 112 may be heat welded to the soft thermoplastic material of the skirt 108 using high frequency (H/F) heat welding. H/F heat welding employs a heat induction technique that can cause the thermoplastic polymer material of the skirt to fuse with the thermoplastic polymer material of the welding side of the thermoplastic sealing strip. In general, heat welding (sometimes referred to as heat fusion) is a welding process used to join two different pieces of a thermoplastic material. Such a process involves heating both pieces simultaneously and pressing them together. The two pieces then cool together and form a permanent bond. Heat welding may further improve waterproofing characteristics because the two thermoplastic materials chemically bond forming a water impermeable surface.

In at least one embodiment, the lid 104 forms an outer surface impermeable to liquids. This impermeable surface can be the combination of the outer surface of the pad 110, the skirt 108, and/or the heat welded thermoplastic sealing strip 112. The properties of heat welding soft thermoplastics may include creating a liquid impermeable seal over the material. When viewed as a whole, in at least one example, the lid 104 forms a continuous liquid impermeable surface for the outer surface of the lid 104. This outer surface fulfills a desired trait of a bag designed for water exposure. A user may safely store containers inside the bag without outside water exposure.

In another example, the skirt 108 can form an outer lip when it closes the body void 106. The body 102 and skirt 108 can also form an inner lip. The two lips may form a seal. This arrangement of the lid 104 enveloping outer edges of the body 102 provides advantages for preventing liquids from entering the body void 106. One of the most common forms of liquid exposure to bags comes from rain or water spray when aboard a vessel such as a boat. Rain or water spray typically impacts a bag from the top side, washing downward along the sides of the bag to a lower elevation. If a skirt forms an outer lip, then the water will wash alongside the outer surface before falling off the bottom edges of the outer lip. Because the edge of the inner lip is higher than the edge of the outer lip, water will not tend to rise up into seal because of gravity. The lid 104 may maintain the seal with the body 102 by some securing force, such as friction between the inner lip and the outer lip, magnetism between enclosed magnets, or some other force.

In at least one embodiment, the lid 104 can be coupled to the body 102 using at least one lid G-Hook fastener (See FIG. 1C) and at least one lid webbing loop 158 as more fully described in reference to FIG. 1C below. It would be understood that where a G-Hook fastener is utilized, magnetic couplings as described herein may also be utilized. In at least one example, the storage apparatus 100 may have at least one pocket 140. In some examples, the at least one pocket 140 contains at least one pocket webbing loop 148 for coupling to the body 102 using at least one pocket G-Hook fastener 147. In yet other examples, the pocket G-Hook fastener 147 may be a hook fastener made of a solid material including, but not limited to, plastic, metal, or similar materials and/or combinations thereof. The pocket webbing loop 148 may be made of a flexible or fabric-like material including, but not limited to, cloth, vinyl, canvas, metal, plastic, or other similar materials and/or combinations thereof. The pocket G-Hook fastener 147 may attach to the body using a plurality of pocket hook couplers including, but not limited to, stitching, thread, glue, adhesive, or fasteners and/or connections or combinations thereof. The pocket webbing loop 148 may attach to the pocket 140 as described in FIG. 15. Additionally, the pocket 140 may have a pocket edge covering 142 as is more fully described in reference to FIG. 15 below.

In at least one embodiment, at least one handle 170 may be attached to a storage apparatus 100 via a soft thermoplastic strip 172. The soft thermoplastic strip comprises edges of the soft thermoplastic strip 174 and an area of stitching 176 as is more fully described in reference to FIG. 8 below. The storage apparatus 100, in at least one example, can further comprise at least one shoulder strap 160 that further comprises a shoulder strap G-Hook fastener 167 and a shoulder strap webbing 162 as is more fully described with reference to FIG. 1B below. A hook side ring, in yet other examples, connects to the storage apparatus 100 via a hook side ring webbing comprising a hook side ring webbing loop 168 as is more fully described in reference to FIG. 14 below. In at least one embodiment, the storage apparatus 100 may have at least one dividing wall 190 that comprises a wall 191, a first edge 192, and a second edge (not illustrated) as is more fully described in reference to FIG. 6A below. In yet further examples, the interior of the body of the storage apparatus may also contain a waterproof liner 195 as is more fully described in reference to FIG. 6A below.

Figure 1B:
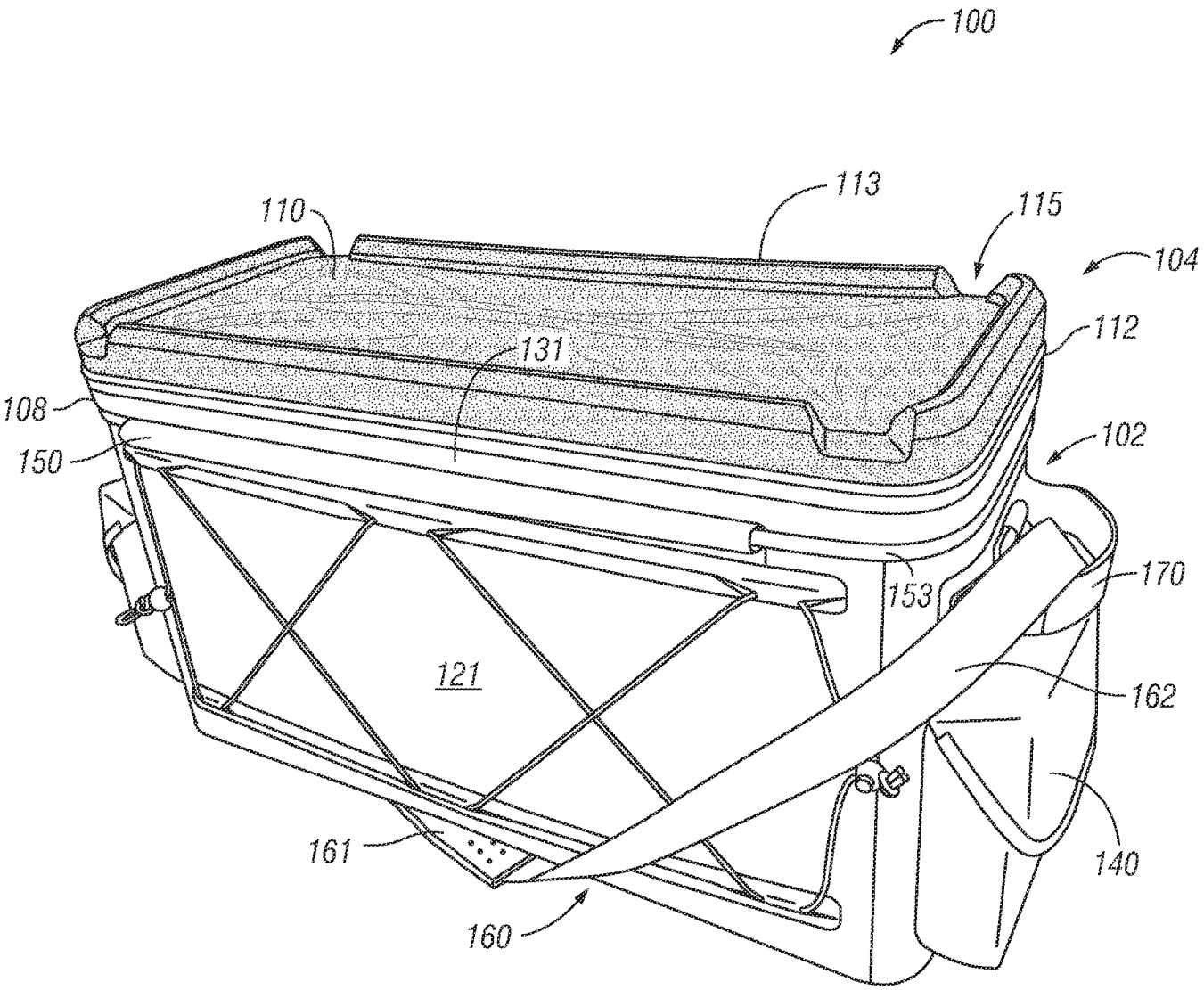
FIG. 1B is an illustration of a rear perspective view of a storage apparatus.

FIG. 1B is an illustration of a rear perspective view of a storage apparatus 100. The rear 121 of the storage apparatus 100, in at least one example, can include additional storage straps 144 that can allow for additional storage of items placed underneath the straps 144. The straps 144 can allow for gear such as rods, boxes, clothing, balls, and/or other items capable of being secured by one or more straps 144. The lid 104 of the storage apparatus 100 may, in yet other examples, have a contour or grooving that allows for liquids such as water, if spilt onto the lid 104, to drain off of the lid 104 through the use of gravity and/or angles.

The storage apparatus 100, can be comprised of a body 102 and a lid 104. In at least one example, the lid 104 forms a seal with the body 102 when they are engaged together. The body 102 is defined by a front wall (See FIG. 1A), a rear wall 131, a first side wall (See FIG. 1A), a second side wall (See FIG. 1E), and a bottom wall (See FIG. 6A) defining a body void (See FIG. 1A) as is more fully described in reference to FIG. 1A above. In yet other examples, the lid is connected to the body via a back hinge 150 as is more fully described in reference to FIG. 15 below.

The lid 104 of the storage apparatus 100 can be comprised of a skirt 108 and a pad 110. The skirt of the lid may include a front wall (See FIG. 1A), a rear wall 131, and opposing side walls (See FIG. 1C) and (See FIG. 1E) as is more fully described in reference to FIG. 1A above.

The pad 110 of the lid 104 is defined by rigid plastic as is more fully described in reference to FIG. 1A above. In at least one example, the pad 110 comprises an upward edge 113 that can define a pad void 107 as is more fully described in reference to FIG. 7B below. The pad 110 may be connected to the top edges of the skirt front, rear 131, and side walls via a thermoplastic sealing strip 112 as is more fully described in reference to FIG. 1A above.

In at least one example, the thermoplastic sealing strip 112 may be heat welded to the soft thermoplastic material of the skirt 108 using heat welding as is more fully described in reference to FIG. 1A above. In at least one example, the lid 104 forms an outer surface impermeable to liquids as is more fully described in reference to FIG. 1A above.

In at least one example, the pad 110 contains downward-sloping channels 115 within the edge 113 to allow for water runoff. This gives the advantage of increasing storage flexibility while maintaining the lid's 104 performance when exposed to water. A desirable trait for bags is for water to easily drain from the top of the bag and down the sides of the bag, especially for bags designed for water exposure. The downward-sloping channels 115 are strategically placed as to direct water runoff at the diagonal corners of the storage apparatus 100. This ensures water runoff is directed away from any securing mechanisms or outer pockets that may be present on the storage apparatus 100. The downward-sloping channels 115 improve the storage apparatus's 100 performance when exposed to water, as water will tend to wash down the channels and off the sides of the body.

In another example, the skirt 108 can form an outer lip when it closes the body void 106 and the body 102 can also form an inner lip. The two lips may form a seal as is more fully described in reference to FIG. 1A above. In at least one example, the storage apparatus 100 may have at least one pocket 140, as is more fully described in reference to FIG. 1A above. In at least one example, at least one handle 170 may be attached to a storage apparatus as is more fully described in reference to FIG. 8 below.

The storage apparatus 100, in at least one example, can further comprise at least one shoulder strap 160 that further comprises a shoulder strap G-Hook fastener (See FIG. 1A) and a shoulder strap webbing 162. It would be understood that where a G-Hook fastener is utilized, magnetic couplings as described herein may also be utilized in place of the G-Hook fastener. It is within the scope of the present disclosure for the shoulder strap 160 to be attached to at least one point along the front wall (See FIG. 1A), the rear wall 121, first side wall (See FIG. 1C), the second side wall (See FIG. 1E), and/or a bottom wall (See FIG. 6A) of the body 102, the lid 104, and/or other similar areas of the storage apparatus 100 capable of supporting weight using a plurality of couplings including, but not limited to, stitching, thread, glue, adhesive, hook and loop, button and slot, snaps, or fasteners and/or connections or combinations thereof. Shoulder strap 160 may be constructed utilizing materials such as, but not limited to, cloth, vinyl, rope, plastic, and/or other similar materials. The shoulder strap 160 allows a user to transport the storage apparatus 100 more easily by supporting the weight of the apparatus on the user's shoulder via the shoulder strap 160. In at least one example, the shoulder strap 160 comprises a shoulder strap grip 161 as is more fully described in reference to FIG. 10 below.

Figure 1C:
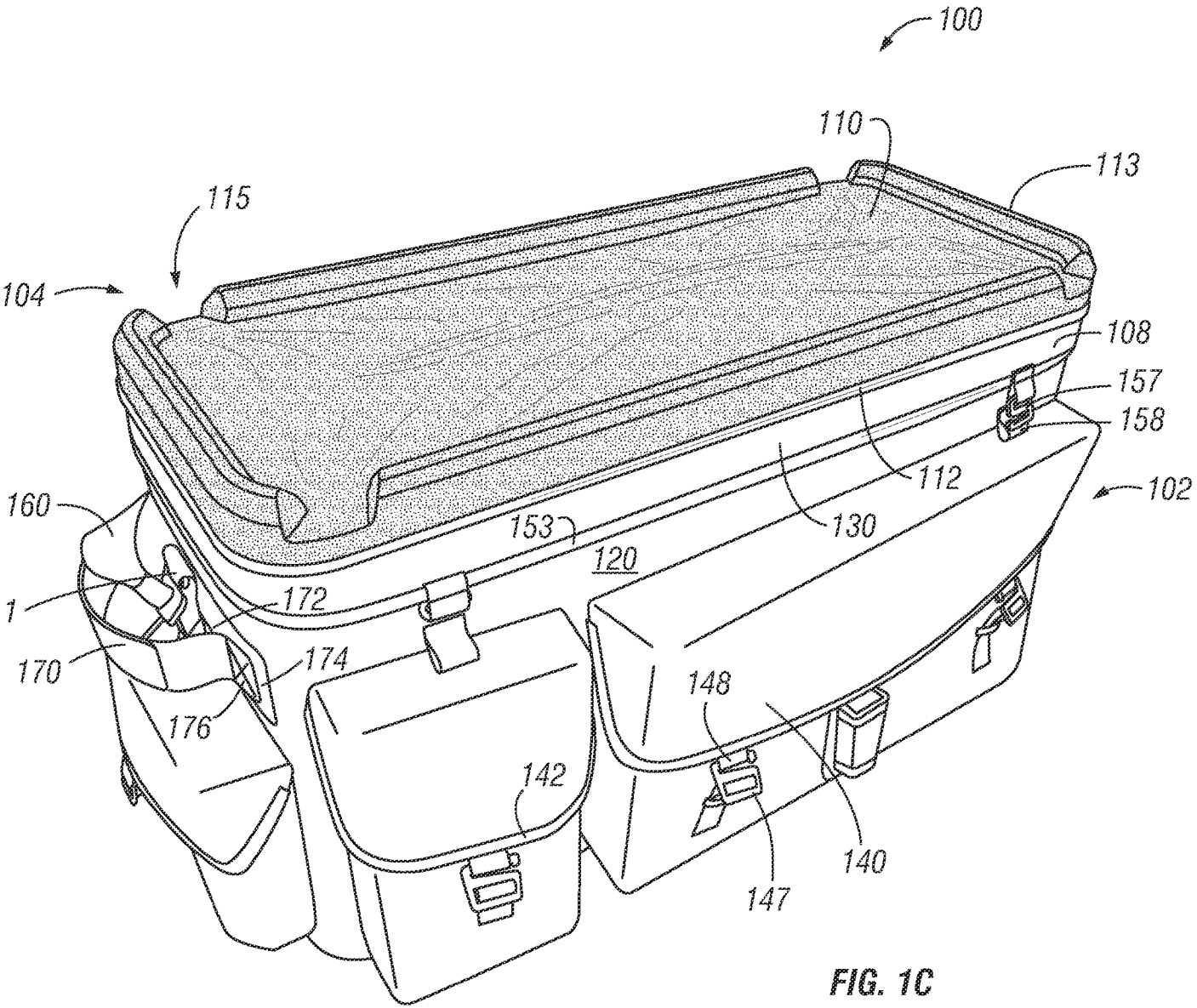
FIG. 1C is an illustration of a front perspective view of a storage apparatus with a lid in a closed position.

FIG. 1C is an illustration of a front view of a storage apparatus 100 with a lid 104 in a closed position. The front perspective of the storage apparatus 100, in at least one example, shows the skirt 108 that extends over a portion of a front wall 120. The extension allows for water to be repelled from the inner portions of the storage apparatus 100. The front wall of the storage apparatus 100 may include one or more pockets or other storage devices that can be coupled to the body 102 of the storage apparatus 100. In at least one example there is a larger pocket and a smaller pocket, while in other examples, there may be three or more similarly sized pockets.

The storage apparatus 100, can be comprised of a body 102 and a lid 104. In at least one embodiment, the lid 104 forms a seal with the body 102 when they are engaged together. The body 102 is defined by a front wall 120, a rear wall (See FIG. 1B), a first side wall (See FIG. 1A), a second side wall (See FIG. 1E), and a bottom wall (See FIG. 6A) defining a body void (See FIG. 1A) as is more fully described in reference to FIG. 1A above.

The lid 104 of the storage apparatus 100 can be comprised of a skirt 108 and a pad 110. The skirt of the lid may include a front wall 130, a rear wall (See FIG. 1B), and opposing side walls 132 and (See FIG. 1E) as is more fully described in reference to FIG. 1A above. The pad 110 of the lid 104 is defined by rigid plastic as is more fully described in reference to FIG. 1A above. In at least one example, the pad 110 comprises an upward edge 113 that can define a pad void 107 as is more fully described in reference to FIG. 7B below. The pad 110 may be connected to the top edges of the skirt front 130, rear (See FIG. 1B), and side walls 132 and (See FIG. 1E) via a thermoplastic sealing strip 112 as is more fully described in reference to FIG. 1A above.

In at least one example, the thermoplastic sealing strip 112 may be heat welded to the soft thermoplastic material of the skirt 108 using heat welding as is more fully described in reference to FIG. 1A above. In at least one example, the lid 104 forms an outer surface impermeable to liquids as is more fully described in reference to FIG. 1A above. In at least one example, the pad 110 contains downward-sloping channels 115 within the edge 113 as is more fully described in reference to FIG. 1B above. In another example, the skirt 108 can form an outer lip when it closes the body void 106 and the body 102 can also form an inner lip. The two lips may form a seal as is more fully described in reference to FIG. 1A above.

In at least one example, the lid 104 can be coupled to the body 102 using at least one lid G-Hook fastener 157 and at least one lid webbing loop 158. It would be understood that where a G-Hook fastener is utilized, magnetic couplings as described herein may also be utilized in place of the G-Hook fastener. In at least one example, the lid G-Hook fastener 157 may be a hook fastener made of a solid material including, but not limited to, plastic, metal, or similar materials and/or combinations thereof. The lid webbing loop 158 may be made of a flexible or fabric like material including, but not limited to, cloth, vinyl, canvas, metal, plastic, or other similar materials and/or combinations thereof. The lid G-Hook fastener 157 may attach to the lid using a plurality of lid hook couplers including, but not limited to, stitching, thread, glue, adhesive, or fasteners and/or connections or combinations thereof. The lid webbing loop 158 may attach to a wall of the body, such as the front wall 120, using a plurality of lid loop couplers including, but not limited to, stitching, thread, glue, adhesive, or fasteners and/or connections or combinations thereof.

In at least one example, the storage apparatus 100 may have at least may have at least one pocket 140, webbing loop 148, G-hook fastener 147, and pocket edge covering 142 as is more fully described in reference to FIG. 1A above. In at least one example, at least one handle 170 may be attached to the storage apparatus 100 via a soft thermoplastic strip 172. The soft thermoplastic strip comprises edges of the soft thermoplastic strip 174 and an area of stitching 176 as is more fully described in reference to FIG. 8 below. The storage apparatus 100, in at least one example, can further comprise at least one shoulder strap 160 as is more fully described in reference to FIG. 1B above.

The storage apparatus 100, in at least one example, can further comprise at least one shoulder strap 160 that further comprises a shoulder strap G-Hook fastener 167 and a shoulder strap webbing 162 as is more fully described in reference to FIG. 1B above. In at least another example, the shoulder strap 160 connects to the storage apparatus 100 via a hook side ring webbing comprising a hook side ring webbing loop 168 as is more fully described in reference to FIG. 14.

Figure 1D:
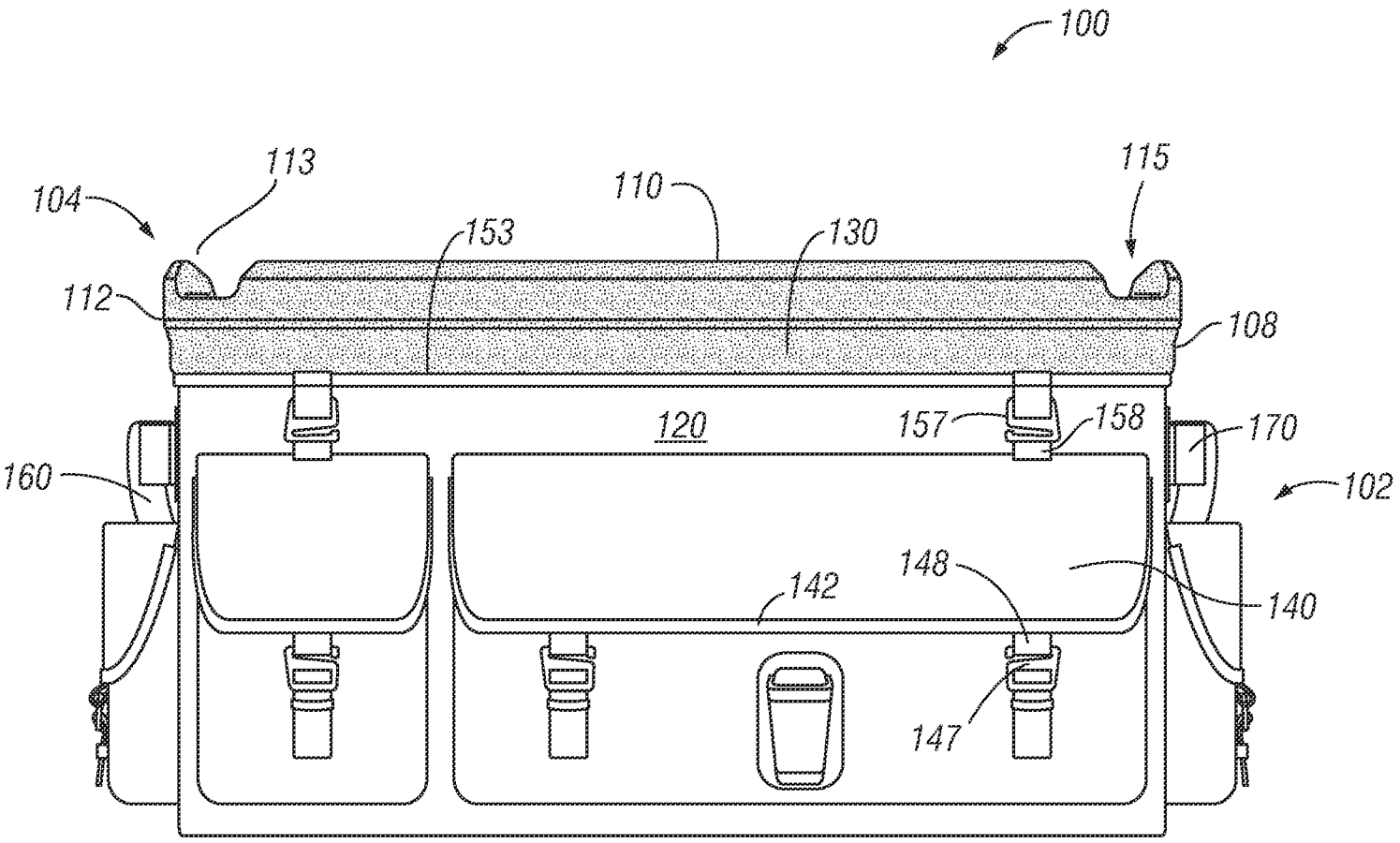
FIG. 1D is an illustration of a front view of a storage apparatus.

FIG. 1D is an illustration of a front view of a storage apparatus 100. The skirt 108 of the storage apparatus 100 engages with the body 102 providing a sealing effect. The sealing effect allows for the prevention of permeation of the main portion of the body 102 by liquids. Similarly, the gap 115 in the lid 104 allows for fluid to drain from the lid 104.

The storage apparatus 100, can be comprised of a body 102 and a lid 104. In at least one embodiment, the lid 104 forms a seal with the body 102 when they are engaged together. The body 102 is defined by a front wall 120, a rear wall (See FIG. 1B), a first side wall (See FIG. 1A), a second side wall (See FIG. 1E), and a bottom wall (See FIG. 6A) defining a body void (See FIG. 1A) as is more fully described in reference to FIG. 1A above.

The lid 104 of the storage apparatus 100 can be comprised of a skirt 108 and a pad 110. The skirt of the lid may include a front wall 130, a rear wall (See FIG. 1B), and opposing side walls (See FIG. 1C) and (See FIG. 1E) as is more fully described in reference to FIG. 1A above. The pad 110 of the lid 104 is defined by rigid plastic as is more fully described in reference to FIG. 1A above. In at least one example, the pad 110 comprises an upward edge 113 that can define a pad void (See FIG. 1B) as is more fully described in reference to FIG. 7B below. The pad 110 may be connected to the top edges of the skirt front wall 130, rear, and side walls via a thermoplastic sealing strip 112 as is more fully described in reference to FIG. 1A above.

In at least one example, the thermoplastic sealing strip 112 may be heat welded to the soft thermoplastic material of the skirt 108 using heat welding as is more fully described in reference to FIG. 1A above. In at least one example, the lid 104 forms an outer surface impermeable to liquids as is more fully described in reference to FIG. 1A above. In at least one example, the pad 110 contains downward-sloping channels 115 within the edge 113 as is more fully described in reference to FIG. 1B above.

In another example, the skirt 108 can form an outer lip when it closes the body void 106 and the body 102 can also form an inner lip. The two lips may form a seal as is more fully described in reference to FIG. 1A above. The outer lip may have an outer lip covering 153 as is more fully described in reference to FIG. 5A. In at least one example, the lid 104 can be coupled to the body 102 using at least one lid G-Hook fastener 157 and at least one lid webbing loop 158 as is more fully described in reference to FIG. 1C above. It would be understood that where a G-Hook fastener is utilized, magnetic couplings as described herein may also be utilized in place of the G-Hook fastener. In at least one example, the storage apparatus 100 may have at least one pocket 140, webbing loop 148, G-hook fastener 147, and pocket edge covering 142 as is more fully described in reference to FIG. 1A above. In at least one example, at least one handle 170 may be attached to a storage apparatus 100 as is more fully described in reference to FIG. 8 below. The storage apparatus 100, in at least one example, can further comprise at least one shoulder strap 160 as is more fully described in reference to FIG. 1B above.

Figure 1E:
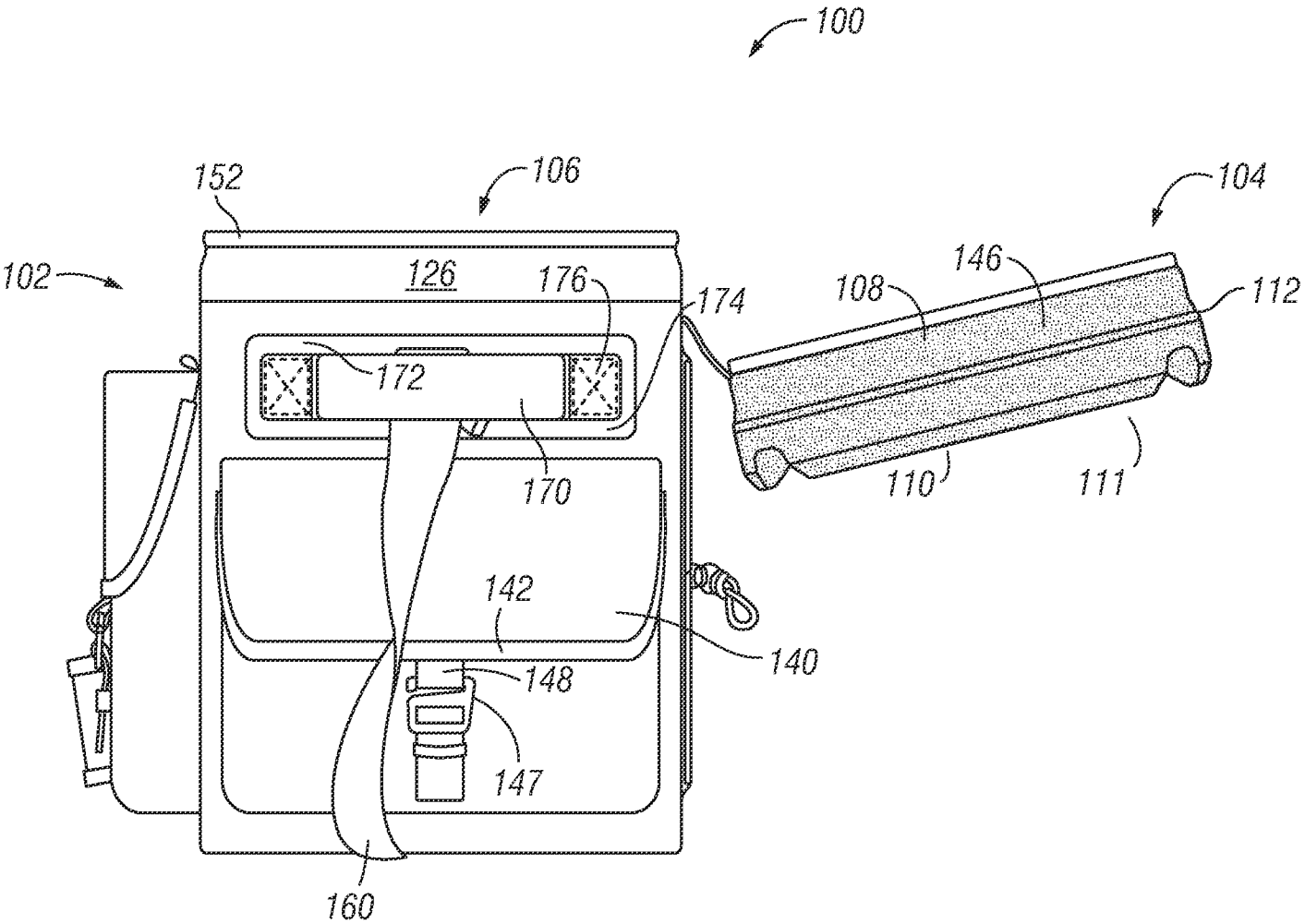
FIG. 1E is an illustration of a side view of a storage apparatus.

FIG. 1E is an illustration of a side view of a storage apparatus 100. From the side view illustration, the two sections of the lid 104 can be seen with the rigid material upper section 110 and the soft material skirt section 108. Between the two sections can be a welded meeting section 112 that allows for the two materials to be joined together in a manner that does not require stitching or other penetrations of the material. This allows the seam to be water or liquid tight.

The storage apparatus 100, can be comprised of a body 102 and a lid 104. In at least one embodiment, the lid 104 forms a seal with the body 102 when they are engaged together. The body 102 is defined by a front wall (See FIG. 1A), a rear wall (See FIG. 1B), a first side wall (See FIG. 1C), a second side wall 123, and a bottom wall (See FIG. 6A) defining a body void 106 as is more fully described in reference to FIG. 1A above. In yet other examples, the lid is connected to the body via a back hinge 150 as is more fully described in reference to FIG. 11.

The lid 104 of the storage apparatus 100 can be comprised of a skirt 108 and a pad 110. The skirt of the lid may include a front wall (See FIG. 1A), a rear wall (See FIG. 1B), and opposing side walls (See FIG. 1C) and 133 as is more fully described in reference to FIG. 1A above.

The pad 110 of the lid 104 is defined by rigid plastic as is more fully described in reference to FIG. 1A above. In at least one example, the pad 110 comprises an upward edge 113 that can define a pad void 107 as is more fully described in reference to FIG. 7B below. The pad 110 may be connected to the top edges of the skirt front (See FIG. 1A), rear (See FIG. 1B), and side walls (See FIG. 1C) and 133 via a thermoplastic sealing strip 112 as is more fully described in reference to FIG. 1A above. In at least one example, the thermoplastic sealing strip 112 may be heat welded to the soft thermoplastic material of the skirt 108 using heat welding as is more fully described in reference to FIG. 1A above.

In at least one example, the lid 104 forms an outer surface impermeable to liquids as is more fully described in reference to FIG. 1A above. In another example, the skirt 108 can form an outer lip when it closes the body void 106 and the body 102 can also form an inner lip. The two lips may form a seal as is more fully described in reference to FIG. 1A above. In at least one example, the inner lip may have an inner lip covering 152 as is more fully described in reference to FIG. 4. In at least one example, the lid 104 can be coupled to the body 102 using at least one lid G-Hook fastener (See FIG. 1A) and at least one lid webbing loop 158 as is more fully described in reference to FIG. 1C above. It would be understood that where a G-Hook fastener is utilized, magnetic couplings as described herein may also be utilized in place of the G-Hook fastener. In at least one example, the storage apparatus 100 may have at least one pocket 140, webbing loop 148, G-hook fastener 147, and pocket edge covering 142 as is more fully described in reference to FIG. 1A above.

In at least one example, at least one handle 170 may be attached to a storage apparatus 100 via a soft thermoplastic strip 172. The soft thermoplastic strip comprises edges of the soft thermoplastic strip 174 and an area of stitching 176 as is more fully described in reference to FIG. 8 below. The storage apparatus 100, in at least one example, can further comprise at least one shoulder strap 160 as is more fully described in reference to FIG. 1B above.

Figure 2A:
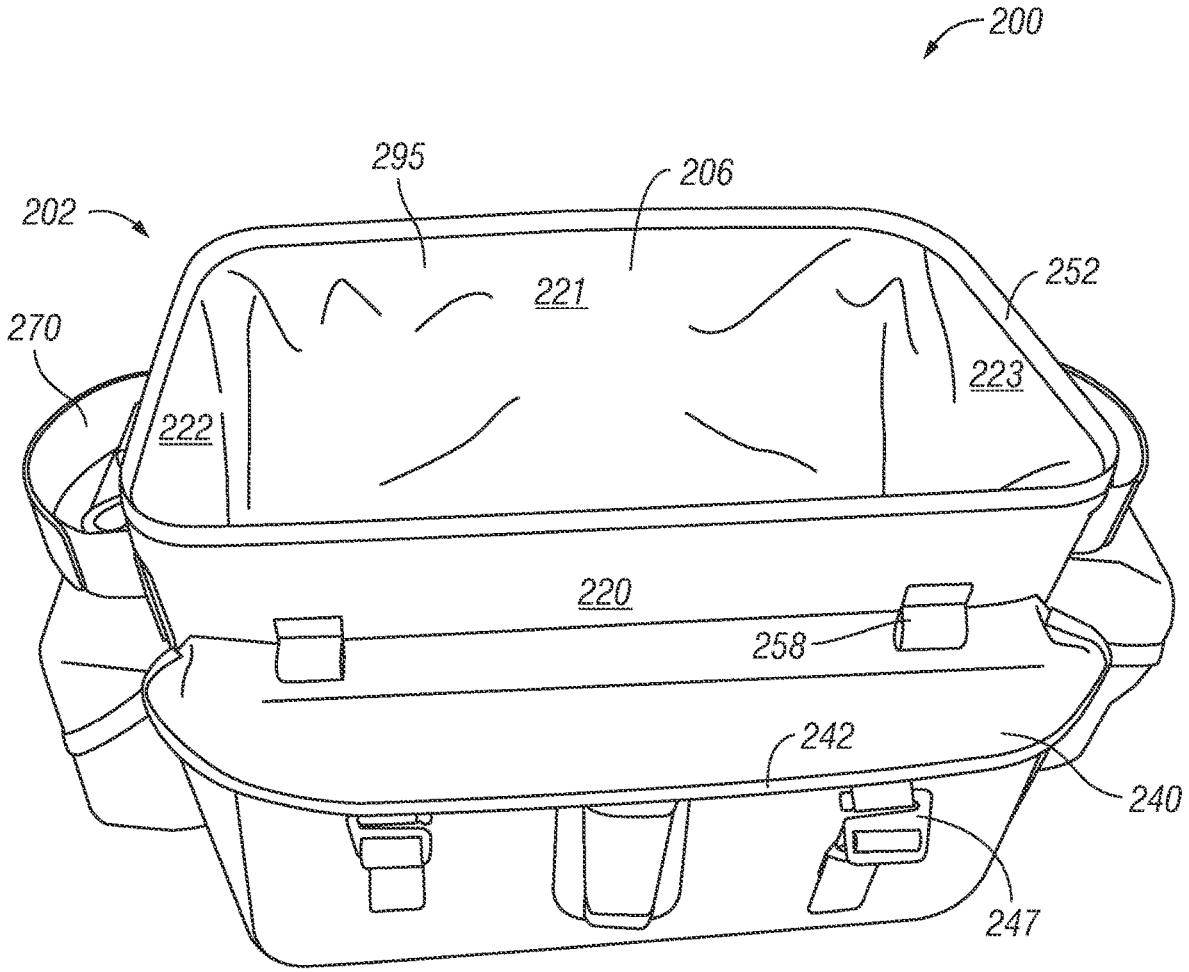
FIG. 2A is an illustration of an front perspective view of an alternative example of a storage apparatus.

FIG. 2A is an illustration of a front perspective view of an alternative example of a storage apparatus 200. The storage apparatus 200 is of a similar design as the storage apparatus shown in FIGS. 1A-1E above, but with a different configuration. For example, the body void 206, in at least one example, does not have a divider. While in other examples, a divider may be provided. Additionally, in at least one example there can be a single front pocket 240 coupled to the front wall 220.

Figure 2B:
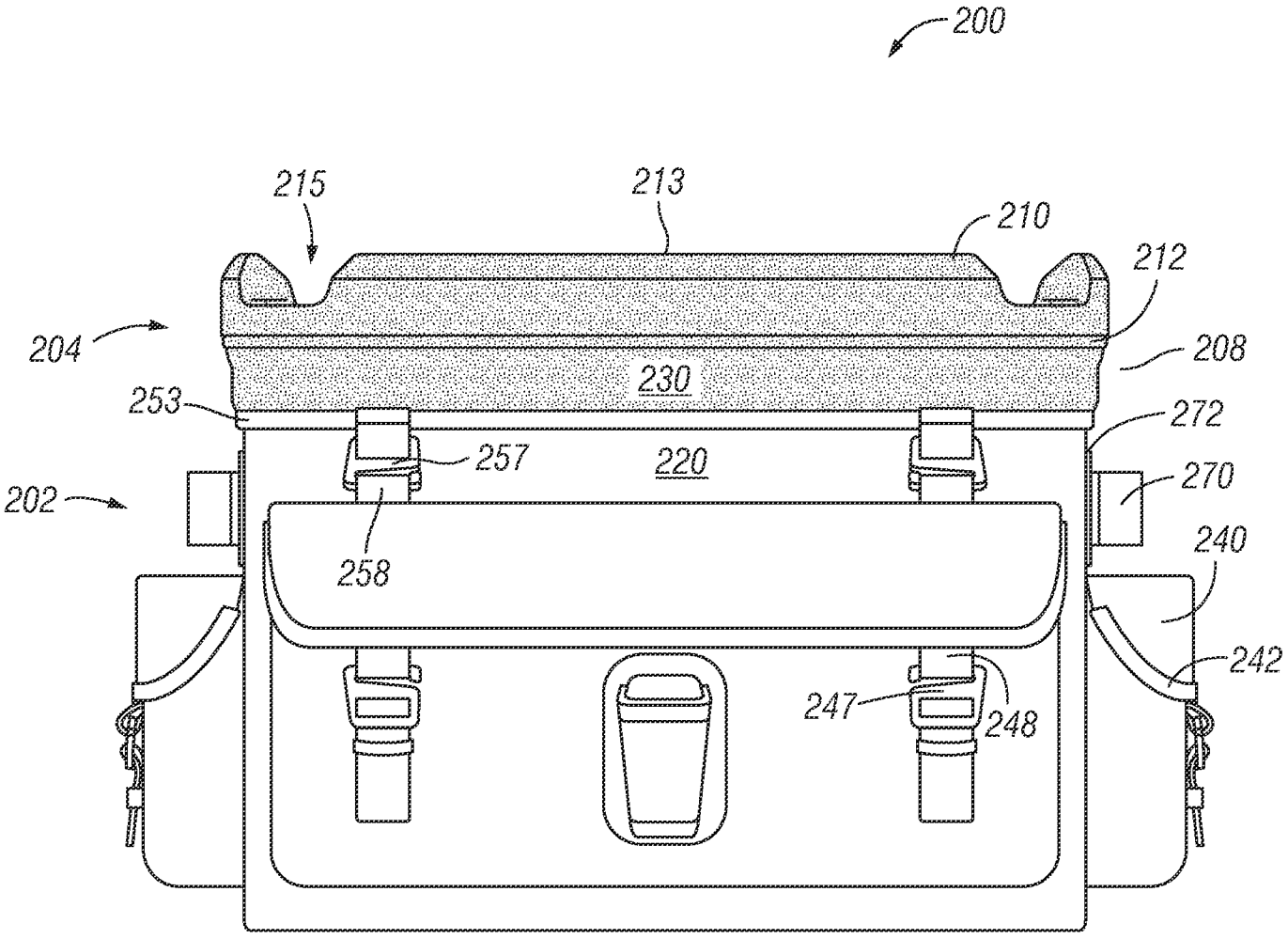
FIG. 2B is an illustration of a front view of an alternative example of a storage apparatus.

The storage apparatus 200, can be comprised of a body 202 and a lid (See FIG. 2B). In at least one embodiment, the lid (See FIG. 2B) forms a seal with the body 202 when they are engaged together. The body 202 is defined by a front wall 220, a rear wall 221, a first side wall 222, a second side wall 223, and a bottom wall (See FIG. 6A) defining a body void 206 as is more fully described in reference to FIG. 1A above.

The lid (See FIG. 2B) of the storage apparatus 200 can be comprised of a skirt (See FIG. 2B) and a pad (See FIG. 2B). The skirt of the lid may include a front wall (See FIG. 2B), a rear wall (See FIG. 2C), and opposing side walls (not illustrated) and 233 as is more fully described in reference to FIG. 1A above. In another example, the skirt 208 can form an outer lip when it closes the body void 206 and the body 202 can also form an inner lip. The two lips may form a seal as is more fully described in reference to FIG. 1A above. In at least one example, the inner lip may have an inner lip covering 252 as is more fully described in reference to FIG. 4. In at least one example, the lid (See FIG. 2B) can be coupled to the body 202 using at least one lid G-Hook fastener (See FIG. 2B) and at least one lid webbing loop 258 as is more fully described in reference to FIG. 1C above. It would be understood that where a G-Hook fastener is utilized, magnetic couplings as described herein may also be utilized in place of the G-Hook fastener. In at least one example, the storage apparatus 200 may have at least one pocket 240, webbing loop 248, G-hook fastener 247, and pocket edge covering 242 as is more fully described in reference to FIG. 1A above.

In at least one example, at least one handle 270 may be attached to a storage apparatus 200 as is more fully described in reference to FIG. 8 below. In at least one example, the storage apparatus 200 may have at least one dividing wall (not illustrated) as is more fully described in reference to FIG. 6A below. In at least one example, the interior of the body of the storage apparatus may also contain a waterproof liner 295 as is more fully described in reference to FIG. 6A below.

FIG. 2B is an illustration of a front view of an alternative example of a storage apparatus 200. The storage apparatus 200 is of a similar design as the storage apparatus shown in FIGS. 1A-1E above, but with a different configuration. For example, the body void 206, in at least one example, does not have a divider. While in other examples, a divider may be provided. Additionally, in at least one example there can be a single front pocket 240 coupled to the front wall 220.

The storage apparatus 200, can be comprised of a body 202 and a lid 204. In at least one embodiment, the lid 204 forms a seal with the body 202 when they are engaged together. The body 202 is defined by a front wall 220, a rear wall (See FIG. 2A), a first side wall (See FIG. 2A), a second side wall (See FIG. 2A), and a bottom wall (See FIG. 6A) defining a body void (See FIG. 2A) as is more fully described in reference to FIG. 1A above.

The lid 204 of the storage apparatus 200 can be comprised of a skirt 208 and a pad 210. The skirt of the lid may include a front wall 230, a rear wall (See FIG. 2C), and opposing side walls (not illustrated) as is more fully described in reference to FIG. 1A. The pad 210 of the lid 204 is defined by rigid plastic as is more fully described in reference to FIG. 1A. In at least one example, the pad 210 comprises an upward edge 213 that can define a pad void (See FIG. 2C) as is more fully described in reference to FIG. 7B. The pad 210 may be connected to the top edges of the skirt front 230, rear (See FIG. 2C), and side walls (not illustrated) via a thermoplastic sealing strip 212 as is more fully described in reference to FIG. 1A above. In at least one example, the thermoplastic sealing strip 212 may be heat welded to the soft thermoplastic material of the skirt 208 using heat welding as is more fully described in reference to FIG. 1A above. In at least one example, the lid 204 forms an outer surface impermeable to liquids as is more fully described in reference to FIG. 1A above.

In at least one example, the pad 210 contains downward-sloping channels 215 within the edge 213 as is more fully described in reference to FIG. 1B above. In another example, the skirt 208 can form an outer lip when it closes the body void 206 and the body 202 can also form an inner lip. The outer lip may have an outer lip covering 253 as is more fully described in reference to FIG. 5A below. The two lips may form a seal as is more fully described in reference to FIG. 1A above. In at least one example, the lid 204 can be coupled to the body 202 using at least one lid G-Hook fastener 257 and at least one lid webbing loop 258 as is more fully described in reference to FIG. 1C above. It would be understood that where a G-Hook fastener is utilized, magnetic couplings as described herein may also be utilized in place of the G-Hook fastener. In at least one example, the storage apparatus 200 may have at least one pocket 240, webbing loop 248, G-hook fastener 247, and pocket edge covering 242 as is more fully described in reference to FIG. 1A above. In at least one example, at least one handle 270 may be attached to a storage apparatus 200 via a soft thermoplastic strip 272. The soft thermoplastic strip comprises edges of the soft thermoplastic strip (See FIG. 2C) and an area of stitching (See FIG. 2C) as is more fully described in reference to FIG. 8 below.

Figure 2C:
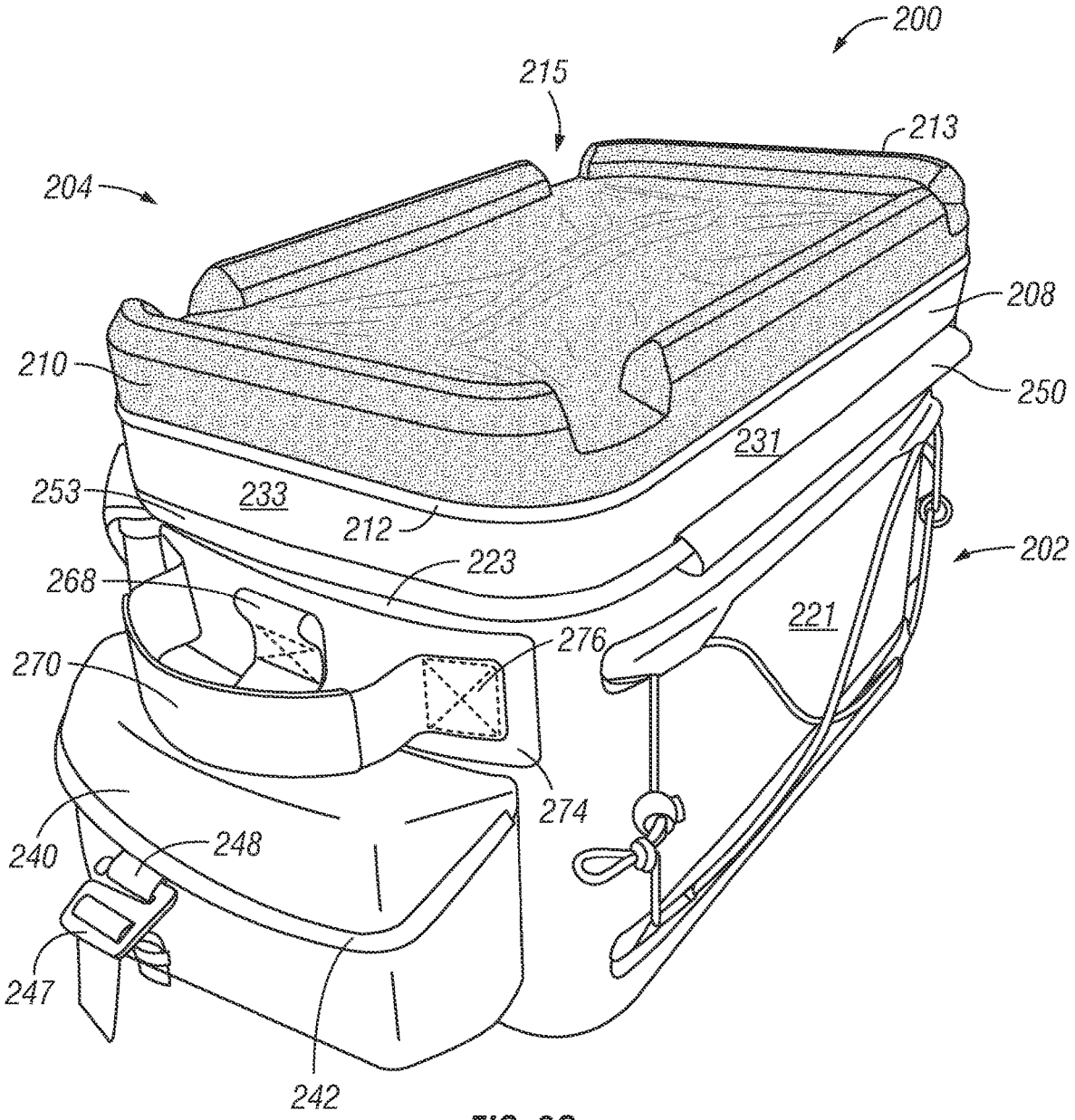
FIG. 2C is an illustration of a rear perspective view of an alternative example of a storage apparatus.

FIG. 2C is an illustration of a rear perspective view of an alternative example of a storage apparatus 200. The storage apparatus 200 is of a similar design as the storage apparatus shown in FIGS. 1A-1E above, but with a different configuration. For example, the body void 206, in at least one example, does not have a divider. While in other examples, a divider may be provided. Additionally, in at least one example there can be a single front pocket 240 coupled to the front wall 220.

The storage apparatus 200 can be comprised of a body 202 and a lid 204. The body 202 is defined by a front wall (See FIG. 2A), a rear wall 221, a first side wall (See FIG. 2A), a second side wall 223, and a bottom wall (See FIG. 6A) defining a body void (See FIG. 2A) as is more fully described in reference to FIG. 1A above. In at least one embodiment, the lid 204 of the storage apparatus 200 can be comprised of a skirt 208 and a pad 210. The skirt of the lid may include a front wall (See FIG. 2B), a rear wall 231, and opposing side walls (not illustrated) and 233 as is more fully described in reference to FIG. 1A above. In yet other examples, the lid is connected to the body via a back hinge 250 as is more fully described in reference to FIG. 11 below.

The pad 210 of the lid 204 is defined by rigid plastic as is more fully described in reference to FIG. 1A above. In at least one example, the pad 210 comprises an upward edge 213 that can define a pad void 207 as is more fully described in reference to FIG. 7B below. The pad 210 may be connected to the top edges of the skirt front (See FIG. 2B), rear 231, and side walls (not illustrated, 233) and via a thermoplastic sealing strip 212 as is more fully described in reference to FIG. 1A above. In at least one example, the thermoplastic sealing strip 212 may be heat welded to the soft thermoplastic material of the skirt 208 using heat welding as is more fully described in reference to FIG. 1A above. In at least one example, the lid 204 forms an outer surface impermeable to liquids as is more fully described in reference to FIG. 1A above. In another example, the skirt 208 can form an outer lip when it closes the body void 206 and the body 202 can also form an inner lip. The outer lip may have an outer lip covering 253 as is more fully described in reference to FIG. 5A below. The two lips may form a seal as is more fully described in reference to FIG. 1A above.

The rear 221 of the storage apparatus 200, in at least one example, can include additional storage straps 244 as is more fully described in reference to FIG. 1B above.

In at least one example, the storage apparatus 200 that may have at least one pocket 240, webbing loop 248, G-hook fastener 247, and pocket edge covering 242 as is more fully described in reference to FIG. 1A above. It would be understood that where a G-Hook fastener is utilized, magnetic couplings as described herein may also be utilized in place of the G-Hook fastener. In some examples, at least one handle 270 may be attached to a storage apparatus 200 via a soft thermoplastic strip 272. The soft thermoplastic strip comprises edges of the soft thermoplastic strip 274 and an area of stitching 276 as is more fully described in reference to FIG. 8 above. In at least one embodiment, the area of stitching 276 may be welded instead of stitched. In at least one example, a hook side ring (not illustrated) connects to the storage apparatus 200 via a hook side ring webbing comprising a hook side ring webbing loop 268 as is more fully described in reference to FIG. 14 below.

Figure 3:
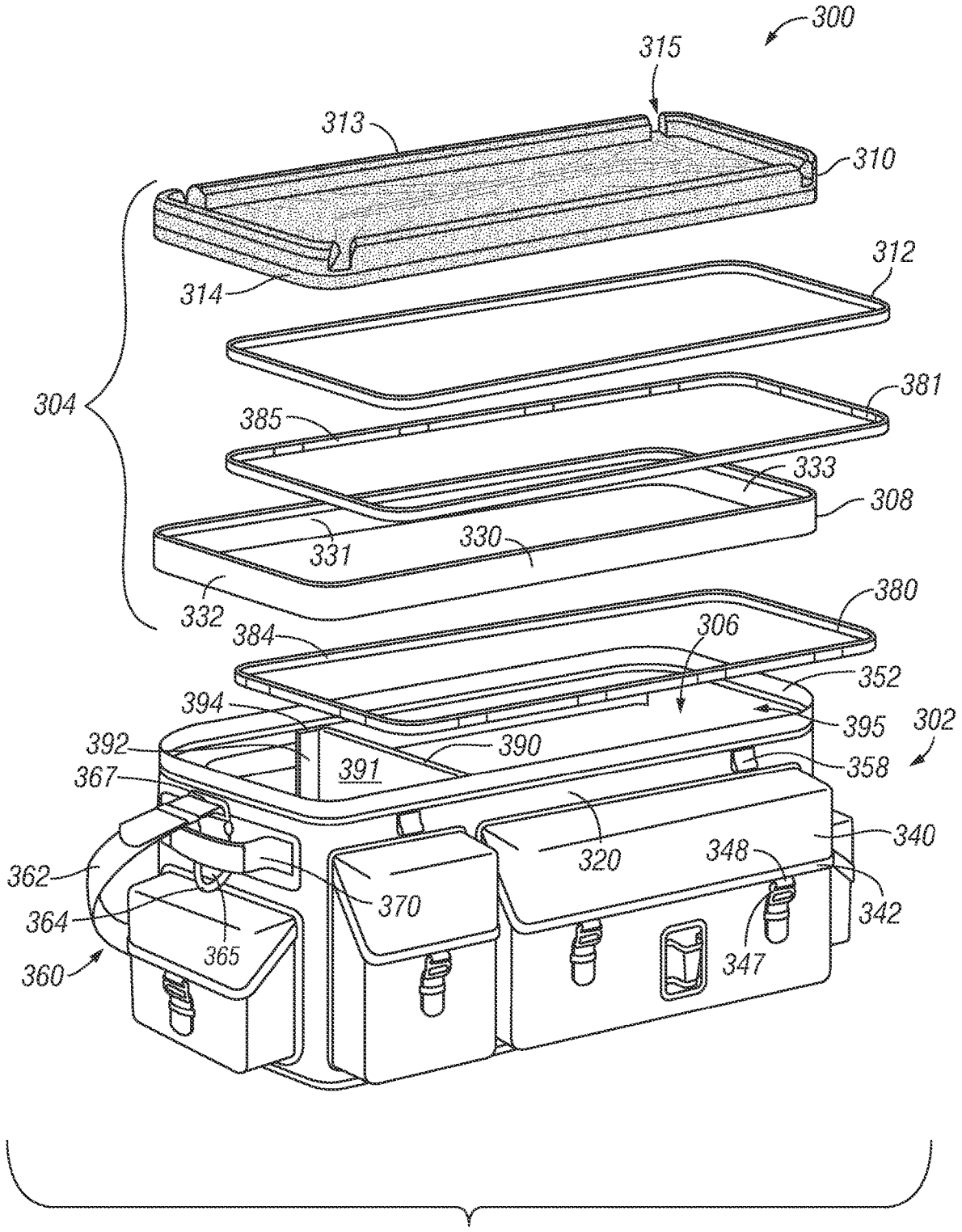
FIG. 3 is an illustration of an exploded view of a storage apparatus.

FIG. 3 is an illustration of an exploded view of a storage apparatus 300. The storage apparatus 300, can be comprised of a body 302 and a lid 304. In at least one embodiment, the lid 304 forms a seal with the body 302 when they are engaged together. The body 302 is defined by a front wall 320, a rear wall (See FIG. 1B), a first side wall (See FIG. 1A), a second side wall (See FIG. 1E), and a bottom wall (See FIG. 6A) defining a body void 306 as is more fully described in reference to FIG. 1A above.

The lid 304 of the storage apparatus 300 can be comprised of a skirt 308 and a pad 310. The skirt of the lid may include a front wall 330, a rear wall 331, and opposing side walls 332 and 333 as is more fully described in reference to FIG. 1A above. The pad 310 of the lid 304 is defined by rigid plastic as is more fully described in reference to FIG. 1A above. In at least one example, the pad 310 comprises an upward edge 313 that can define a pad void 307 as is more fully described in reference to FIG. 7B below. The pad 310 may be connected to the top edges of the skirt front 330, rear 331, and side walls 332 and 333 via a thermoplastic sealing strip 312 as is more fully described in reference to FIG. 1A above.

In at least one example, the thermoplastic sealing strip 312 may be heat welded to the soft thermoplastic material of the skirt 308 using heat welding as is more fully described in reference to FIG. 1A above. In at least one example, the lid 304 forms an outer surface impermeable to liquids as is more fully described in reference to FIG. 1A above. In another example, the skirt 308 can form an outer lip when it closes the body void 306 and the body 302 can also form an inner lip. The two lips may form a seal as is more fully described in reference to FIG. 1A above.

In at least one example, the lid 304 can be coupled to the body 302 using at least one lid G-Hook fastener (not illustrated) and at least one lid webbing loop 358, as is more fully described in reference to FIG. 1C above. It would be understood that where a G-Hook fastener is utilized, magnetic couplings as described herein may also be utilized in place of the G-Hook fastener. In at least one example, the storage apparatus 300 may have at least one pocket 340, webbing loop 348, G-hook fastener 347, and pocket edge covering 342 as is more fully described in reference to FIG. 1A above. In at least one example, at least one handle 370 may be attached to a storage apparatus 300 as is more fully described in reference to FIG. 8 below.

The storage apparatus 300, in at least one example, can further comprise at least one shoulder strap 360 that further comprises a shoulder strap G-Hook fastener 367 and a shoulder strap webbing 362 as is more fully described in reference to FIG. 1B above. In at least one example, a hook side ring 364 comprising a hook side ring void 365 connects to the storage apparatus 300 via a hook side ring webbing (not illustrated) as is more fully described in reference to FIG. 14 below.

In at least one example, at least one magnet 380 is enclosed within the body 302 and at least one magnet 381 is enclosed within the skirt 308. The at least one magnet enclosed within the body 380 is positioned to magnetically couple with the at least one magnet enclosed within the skirt 381 when the lid 304 closes the body void 306. When the at least one magnet enclosed within the body 380 couples with the at least one magnet enclosed within the skirt 381, the seal the lid 304 forms with the body 302 is strengthened. This is advantageous because a strengthened seal contributes to liquid impermeability. In at least one example, the at least one magnet enclosed within the body 380 is embedded in a first strip 384 in the area that forms the inner lip. Additionally, the at least one magnet enclosed within the skirt 381 is embedded in a second strip 385 in the area that forms the outer lip. When the lid 304 closes the body void 306, the at least one magnet in the inner lip 380 magnetically adheres with the at least one magnet in the outer lip 381. This example is advantageous because the strips 384 and 385 position the embedded magnets in a stable arrangement. Additionally, the strips 384 and 385 enable the placement of magnets in a set pattern along the perimeter of the inner and outer lip. This set pattern enables a consistent magnetic adherence on the entire perimeter of the lid 304.

In at least one example, the lid 304 seals the body 302 by enveloping the outer edge of the body 302 with the lid 304 and by adhering the at least one magnet enclosed within the skirt 381 to the at least one magnet enclosed within the body 380. This further strengthens the seal. Because the lid 304 seals the body 302 by both friction and magnetic adherence, the lid 304 gains further liquid impermeability. This additional seal strength improves bag performance as it lessens the likelihood of the lid 304 unexpectedly opening the body void 306, potentially exposing the contents to water intrusion.

In at least one example, the rigid pad 310 comprises a disposed lip 314 that projects around a perimeter of the pad 310. In at least one example, the disposed lip 314 projects from the bottom of the pad 310. Because this disposed lib 314 now forms the bottom edges of the pad 310, the thermoplastic sealing strip 312 is sewn to the disposed lip 314. This disposed lip 314 helps to offset the width increase caused by attaching the thermoplastic sealing strip 312 to the pad 310, creating a steeper lid. This steeper lid improves water runoff and assists in preventing water from pooling on top of the lid.

In at least one example, the storage apparatus 300 may have at least one dividing wall 390 that comprises a wall 391, a first edge 392, and a second edge (not illustrated) as is more fully described in reference to FIG. 6A below. The dividing wall 390 may also have a securing mechanism 394 as is more fully described in reference to FIG. 6B below. In at least one example, the interior of the body of the storage apparatus may also contain a waterproof liner 395 as is more fully described in reference to FIG. 6A below.

Figure 4:
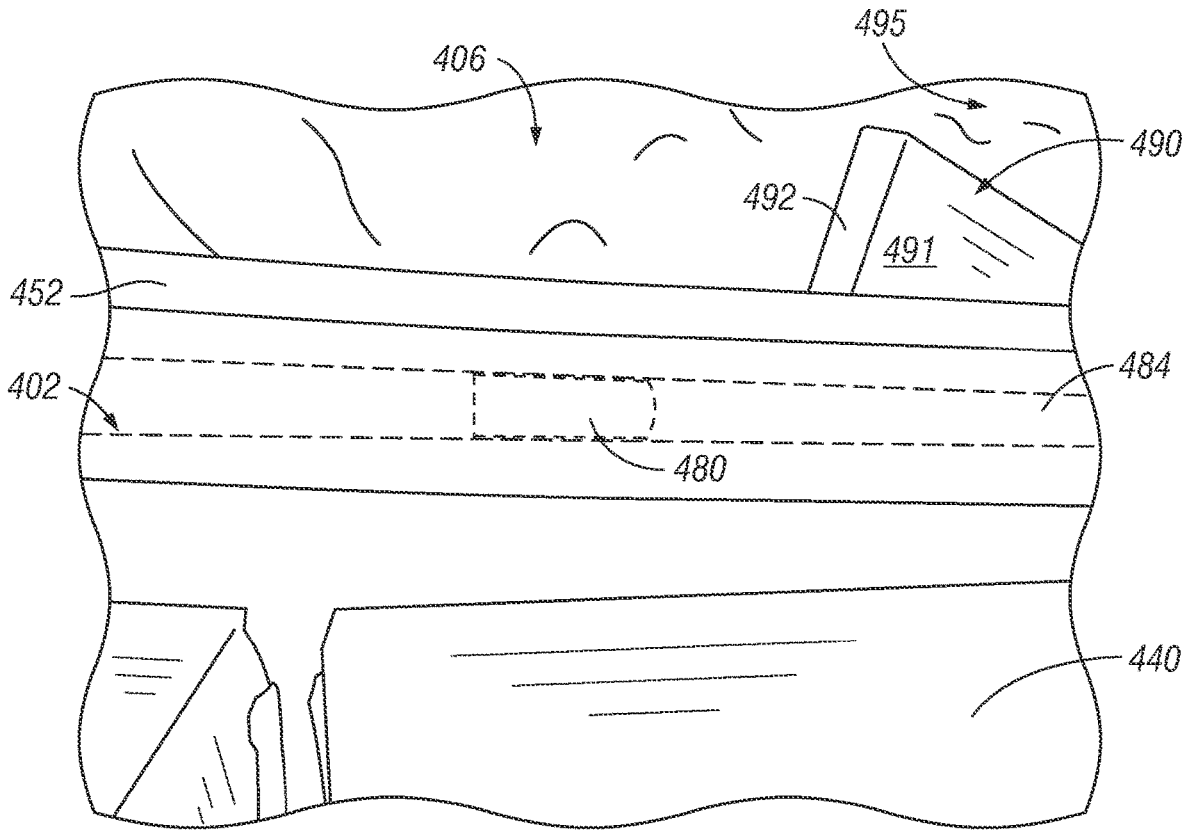
FIG. 4 is an illustration of a close-up side view of a storage apparatus.

FIG. 4 is an illustration of a close-up side view of a storage apparatus 400. In at least one example, the inner lip may have an inner lip covering 452. The inner lip covering 452 may be made of a flexible or fabric like material including, but not limited to, cloth, vinyl, canvas, metal, plastic, or other similar materials and/or combinations thereof. The inner lip covering 452 may attach to the inner edge using a plurality of inner lip couplers including, but not limited to, stitching, thread, glue, adhesive, or fasteners and/or connections or combinations thereof. In at least one example, the inner lip covering 452 comprises soft thermoplastic that is heat welded to the inner lip of the body 402. The inner lip covering 452 protects the edge of the inner lip from wear and tear, as it is a portion of the body 402 that often touches a lid 404.

A storage apparatus 400, can be comprised of the body 402 and the lid (not illustrated) as is more fully described in reference to FIG. 1A above. In at least one example, the lid (not illustrated) forms a seal with the body 402 when they are engaged together. The body 402 may define a body void 406 as is more fully described in reference to FIG. 1A above. In another example, the lid (not illustrated) can form an outer lip when it closes the body void 406 and the body 402 can also form an inner lip. The two lips may form a seal as is more fully described in reference to FIG. 1A above.

FIG. 4 also illustrates a close-up view of an example of the at least one magnet enclosed within the body 402. The outline of the first strip 484 in the area that forms this inner lip is visible. In at least one example, the magnets 480 are spaced at a set distance. In at least one example, at least one magnet 480 is enclosed within the body 402 in a first strip 484 and at least one magnet (not illustrated) is enclosed within the lid (not illustrated) in a second strip (not illustrated) as is more fully described in reference to FIG. 3 above. In at least one example, the storage apparatus 400 may have at least one pocket 440 as is more fully described in reference to FIG. 1A above.

Figure 5A:
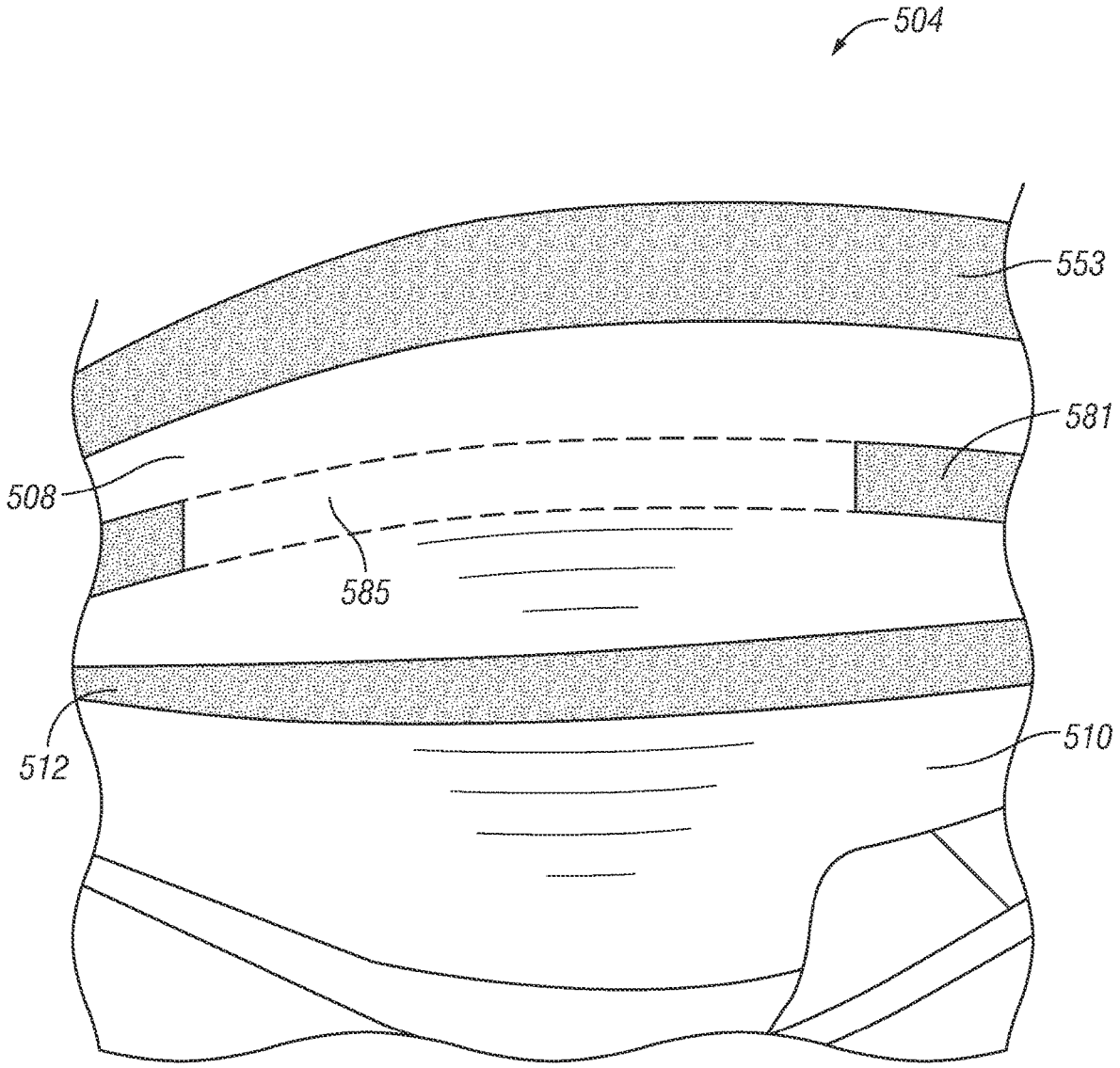
FIG. 5A is an illustration of a close-up side view of a lid in the area that forms an outer lip.

FIG. 5A is an illustration of a close-up side view of a lid 504 in the area that forms an outer lip. The illustration FIG. 5A shows at least one example of how the pad 510 connects to the skirt 508 via the thermoplastic sealing strip 512.

The storage apparatus (not illustrated), can be comprised of a body (not illustrated) and a lid 504. The lid 504 may form a seal with the body (not illustrated) when they are engaged together. The body (not illustrated) may define a body void (not illustrated) as is more fully described in reference to FIG. 1A above. The lid 504 can be comprised of a skirt 508 and a pad 510 as is more fully described in reference to FIG. 1A above. The pad 510 of the lid 504 is defined by rigid plastic as is more fully described in reference to FIG. 1A above. The pad 510 may be connected to the skirt 508 via a thermoplastic sealing strip 512 as is more fully described in reference to FIG. 1A above.

In at least one embodiment, the thermoplastic sealing strip 512 may be heat welded to the soft thermoplastic material of the skirt 508 using heat welding as is more fully described in reference to FIG. 1A above. In at least one example, the lid 504 forms an outer surface impermeable to liquids as is more fully described in reference to FIG. 1A above. In another example, the skirt 508 can form an outer lip when it closes the body void (not illustrated) and the body (not illustrated) can also form an inner lip. The two lips may form a seal as is more fully described in reference to FIG. 1A above.

In at least one example, the outer lip may have an outer lip covering 553. The outer lip covering 553 may be made of a flexible or fabric like material including, but not limited to, cloth, vinyl, canvas, metal, plastic, or other similar materials and/or combinations thereof. The outer lip covering 553 may attach to the skirt 508 bottom edges using a plurality of outer lip couplers including, but not limited to, stitching, thread, glue, adhesive, or fasteners and/or connections or combinations thereof. In at least one example, the outer lip covering 553 comprises soft thermoplastic that is heat welded to the outer lip of the lid 504. The outer lip covering 553 protects the edge of the outer lip from wear and tear, as it is the portion of the lid 504 that often touches a body (not illustrated). Looking again to FIG. 5A, the thermoplastic sealing strip 512 is shown connecting and providing a seal between the rigid pad 510 and the soft thermoplastic skirt 508.

In at least one example, at least one magnet (not illustrated) is enclosed within the body (not illustrated) in a first strip (not illustrated) and at least one magnet 581 is enclosed within the skirt 508 in a second strip 585 as is more fully described in reference to FIG. 3 above. In at least one example, the interior of the body of the storage apparatus may also contain a waterproof liner 595 as is more fully described in reference to FIG. 6A below.

Figure 5B:
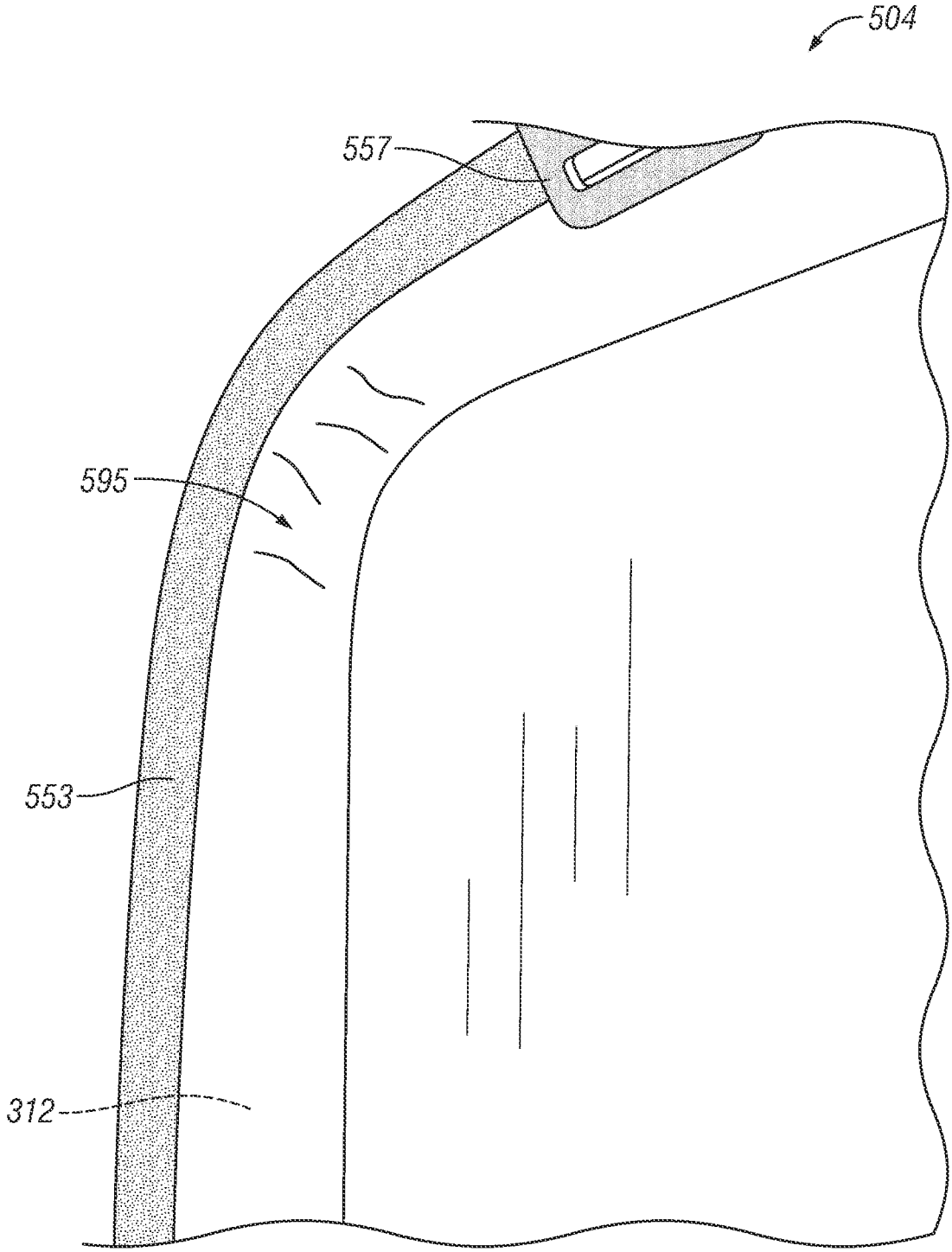
FIG. 5B is an illustration of a close-up bottom view of a lid in the area that forms an outer lip.

FIG. 5B is an illustration of a close-up bottom view of a lid in the area that forms an outer lip. The storage apparatus 500, can be comprised of a body (not illustrated) and a lid 504. The body defines a body void (not illustrated) as is more fully described in reference to FIG. 1A above.

In at least one embodiment, the lid 504 can form an outer lip when it closes the body void (not illustrated) and the body (not illustrated) can also form an inner lip. The two lips may form a seal as is more fully described in reference to FIG. 1A above. In at least one example, the outer lip may have an outer lip covering 553 as is more fully described in reference to FIG. 5A above.

In at least one embodiment, at least one magnet (not illustrated) is enclosed within the body (not illustrated) in a first strip (not illustrated) and at least one magnet 581 is enclosed within the lid 504 in a second strip 585 as is more fully described in reference to FIG. 3 above. In at least one example, the interior of the body of the storage apparatus may also contain a waterproof liner 595 as is more fully described in reference to FIG. 6A below.

In at least one example, the lid 504 can be coupled to the body 502 using at least one lid G-Hook fastener 557 and at least one lid webbing loop (not illustrated) as is more fully described in reference to FIG. 1C above. It would be understood that where a G-Hook fastener is utilized, magnetic couplings as described herein may also be utilized in place of the G-Hook fastener.

Figure 6A:
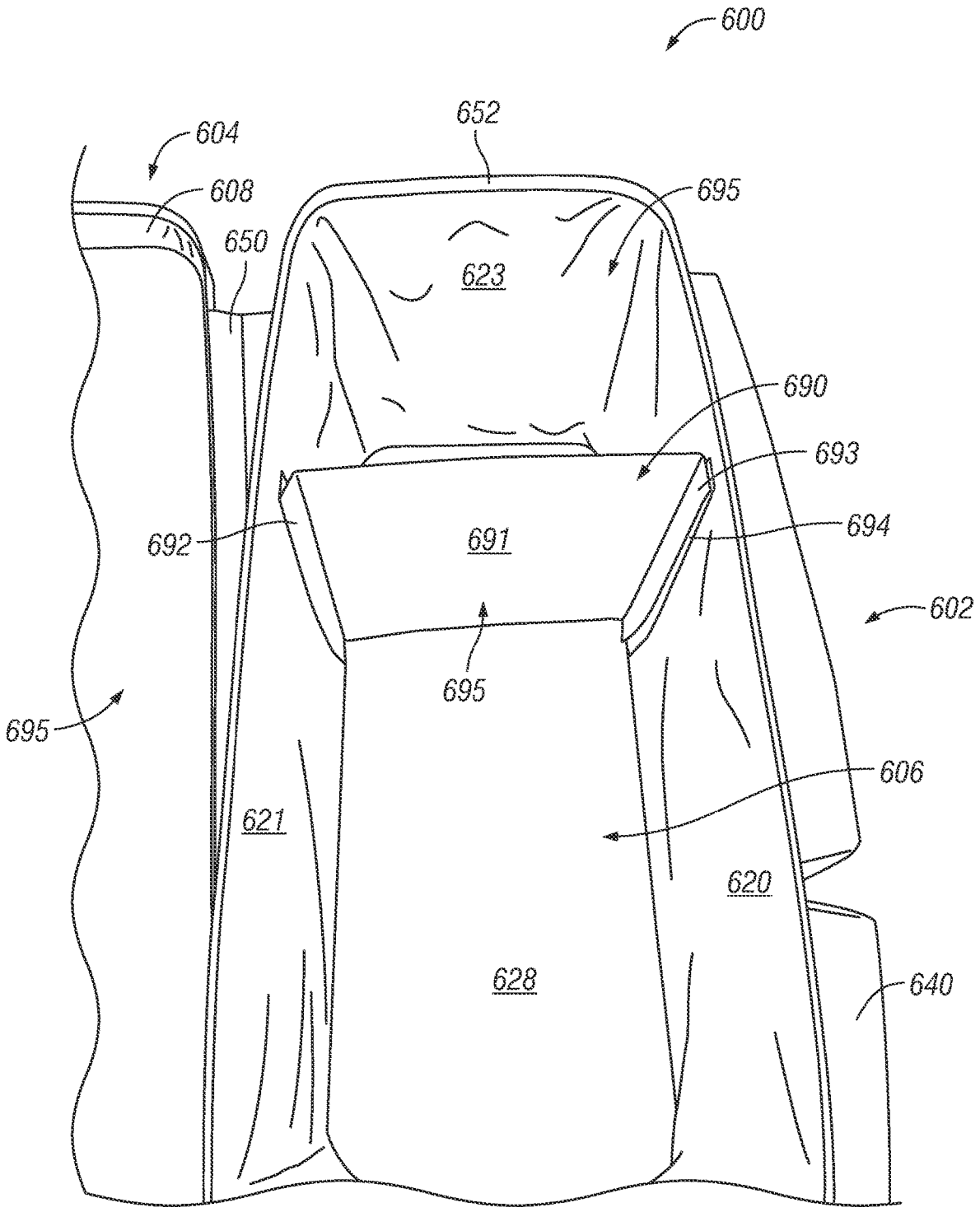
FIG. 6A is an illustration of a top perspective view of the interior of a storage apparatus.

FIG. 6A is an illustration of a top perspective view of the interior of a storage apparatus 600. The storage apparatus 600, can be comprised of a body 602 and a lid 604. The lid 604 may form a seal with the body 602 when they are engaged together. The body 602 is defined by a front wall 620, a rear wall 621, a first side wall (See FIG. 1A), a second side wall 623, and a bottom wall 624 defining a body void 606 as is more fully described in reference to FIG. 1A above. In yet other examples, the lid is connected to the body via a back hinge 650 as is more fully described in reference to FIG. 11 below.

The lid 604 of the storage apparatus 600 can be comprised of a skirt 608 and a pad (not illustrated) as is more fully described in reference to FIG. 1A above. The pad (not illustrated) of the lid 604 is defined by rigid plastic as is more fully described in reference to FIG. 1A above. The pad (not illustrated) may be connected to the skirt 608 via a thermoplastic sealing strip (not illustrated) as is more fully described in reference to FIG. 1A above.

In at least one example, the lid 604 forms an outer surface impermeable to liquids as is more fully described in reference to FIG. 1A above. In another example, the skirt 608 can form an outer lip when it closes the body void 606 and the body 602 can also form an inner lip. The two lips may form a seal as is more fully described in reference to FIG. 1A above.

In at least one example, the inner lip may have an inner lip covering 652 as is more fully described in reference to FIG. 4 above. In at least one example, the storage apparatus 600 may have at least one pocket 640 as is more fully described in reference to FIG. 1A above.

In at least one example, the storage apparatus 600 may have at least one dividing wall 690 that comprises a wall 691, a first edge 692, and a second edge 693. The storage apparatus 600 is configured to removably couple the dividing wall 690. Each edge 692 and 693 of the wall 690 couples to opposing sides of the body void 606 by a securing mechanism 694. This example further improves the storage organization in the body void 606. The dividing wall 690 permits a user to arrange storage containers in different sections of the body void 606 or remove the dividing wall 690 to use the entire body void 606. This additional flexibility improves the performance of the storage system. In at least one example, the interior of the body of the storage apparatus may also contain a waterproof liner 695 that may be as is more fully described in reference to FIG. 6B below.

FIG. 6A also illustrates a storage system. In at least one example, the storage system comprises at least one dividing wall 690 and a storage apparatus 600. The at least one dividing wall 690 comprises a wall 691, a first edge 692, and a second edge 693. The storage apparatus 600 is configured to removably couple the dividing wall 600. The storage apparatus comprises a body 600, which defines a body void 606, and a lid 604, that closes the body void 606, having a skirt 608 and a pad (not illustrated). Each edge 692 and 694 of the wall 690 couples to opposing sides of a body void 606 of a body 602 by a securing mechanism 694. This storage system maintains the advantages of the storage apparatus 600 discussed above while further improving the storage organization in the body void 606. The dividing wall 690 permits a user to arrange storage containers in different sections of the body void 606 or remove the dividing wall 690 to use the entire body void 606. This additional flexibility improves the performance of the storage system.

Figure 6B:
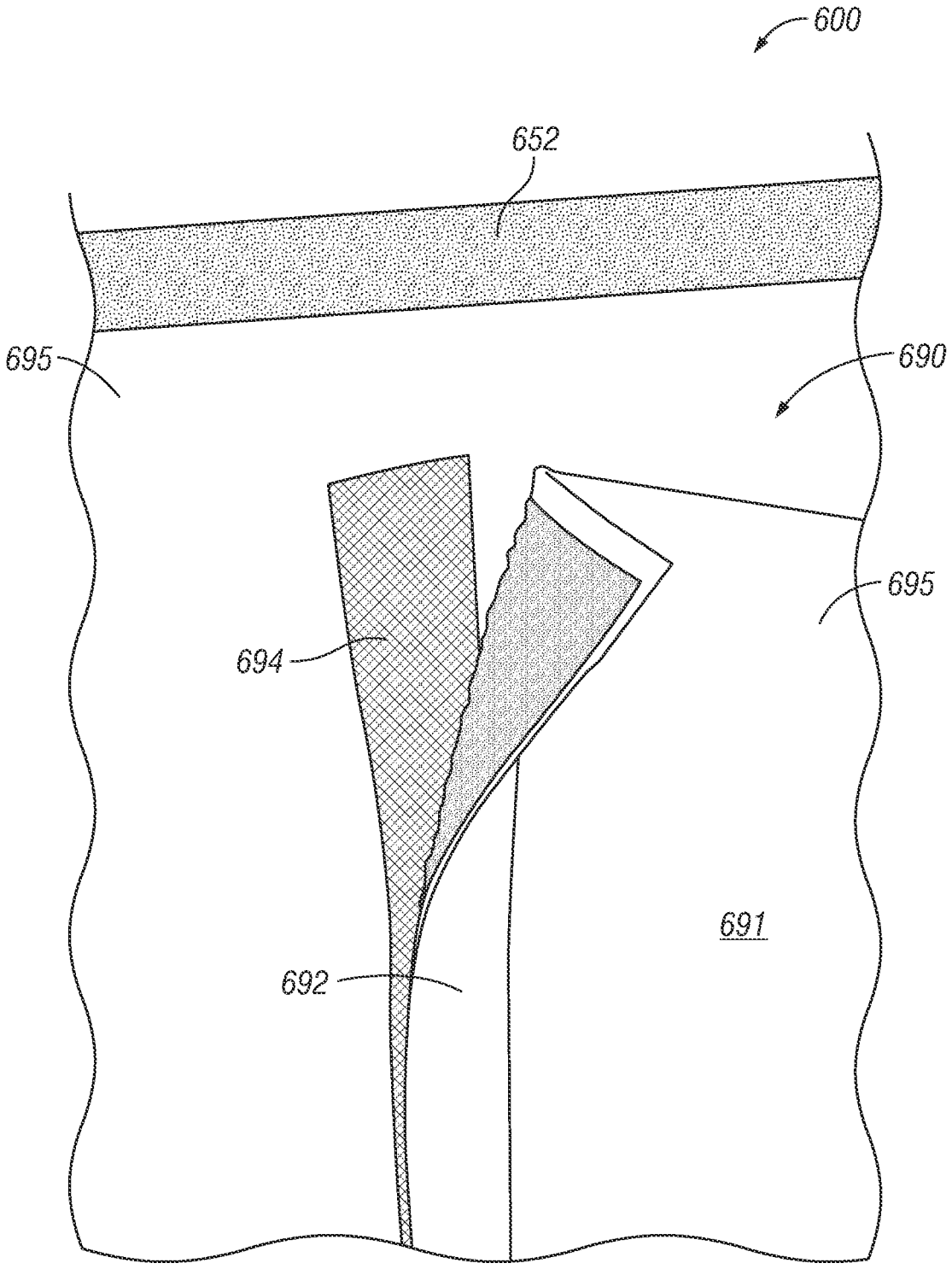
FIG. 6B is an illustration of a close-up view of a dividing wall removably coupled to the storage apparatus.

FIG. 6B illustrates a close-up view of a dividing wall 690 removably coupled to the storage apparatus 600. The storage apparatus 600, can be comprised of a body 602 and a lid (See FIG. 6A)). The lid (See FIG. 6A) may form a seal with the body 602 when they are engaged together. The body 602 may define a body void (See FIG. 6A) as is more fully described in reference to FIG. 1A above.

In another example, the lid (See FIG. 6A) can form an outer lip when it closes the body void (See FIG. 6A) and the body 602 can also form an inner lip. The two lips may form a seal as is more fully described in reference to FIG. 1A above. In at least one example, the inner lip may have an inner lip covering 652 as is more fully described in reference to FIG. 4 above.

In at least one example, at least one magnet 680 is enclosed within the body 602 in a first strip 684 and at least one magnet (not illustrated) is enclosed within the lid (See FIG. 6A) in a second strip (not illustrated) as is more fully described in reference to FIG. 3 above.

In at least one example, the storage apparatus 600 may have at least one dividing wall 690 that comprises a wall 691, a first edge 692, and a second edge 693. The storage apparatus 600 is configured to removably couple the dividing wall 690. Each edge 692 and 693 of the wall 690 couples to opposing sides of the body void 606 by a securing mechanism 694. This example further improves the storage organization in the body void 606. The dividing wall 690 permits a user to arrange storage containers in different sections of the body void 606 or remove the dividing wall 690 to use the entire body void 606. This additional flexibility improves the performance of the storage system.

In at least one example, the securing mechanism 694 is a hook-and-loop fastener. The securing mechanism 694 is attached to the body 602 and each edge of the dividing wall 692 and 693 using heat welding. This securing mechanism has the advantage of not piercing the waterproof liner 695 to couple the dividing wall 690 to the opposing sides of the body void 606. As discussed above, materials that are not pierced have better water-resistant properties. Additionally, heat welding has the advantage of creating a waterproof seal around the edges of the welding. These advantages help contribute to preventing water intrusion into the storage apparatus 600. This is only an example securing mechanism and other securing techniques, such as coupling magnets, clasps, buttons, snaps, or a combination thereof, or other removably coupled securing means may be used.

In at least one example, the interior of the body of the storage apparatus may also contain a waterproof liner 695 that may be disposed along inner surfaces of the body 602 and the lid 604, as well as the outer surface of the dividing wall 690. The liner 695 may be formed from a single piece of material, or may be from of multiple pieces of like material that are permanently joined together, such as through heat welding or a bonding adhesive. The finished waterproof liner 695 may then be placed within the body 602 and lid (See FIG. 6A) of the storage apparatus 600, and secured in place by any of a number of techniques. Similarly, the liner 695 may envelop the outer surface of the dividing wall 690, forming a continuous waterproof outer surface. Thus, an example method of manufacturing a storage apparatus 600 as disclosed herein may further include disposing a waterproof liner 695 along inner surfaces of the body 602 and the lid (See FIG. 6A), and enveloping the dividing wall 690 with the liner 695. Other examples may include, disposing insulation between a waterproof liner 695 and the body 602 and lid (See FIG. 6A), as well as between a waterproof liner 695 and the dividing wall 690. In some examples, the composition of the liner 695 material is deemed safe under California Proposition 65, or other similar protective legislation.

Figure 7A:
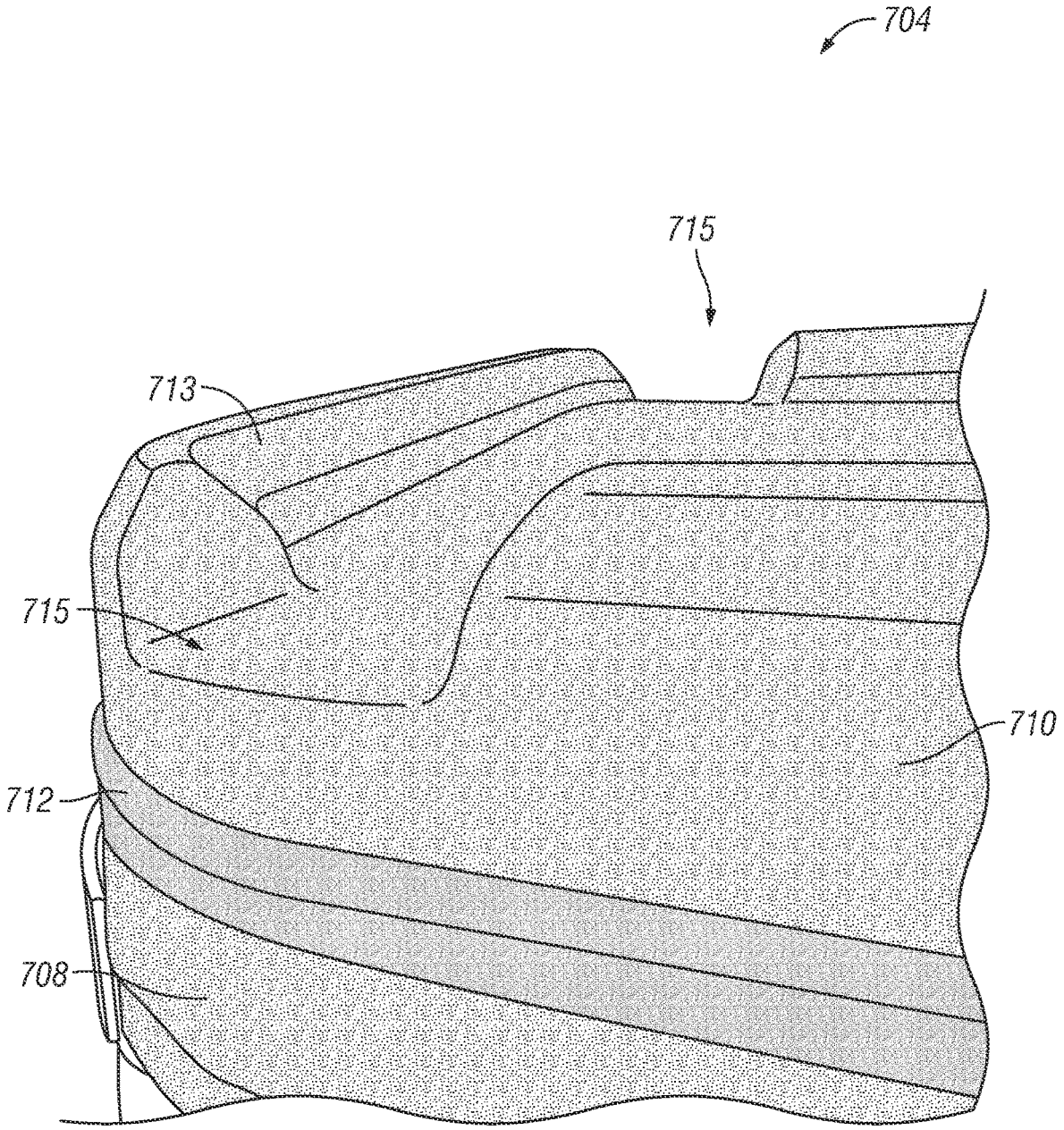
FIG. 7A is an illustration of a close-up view of a pad containing downward-sloping channels.

FIG. 7A is an illustration of a close-up view of a pad 710 containing downward-sloping channels 715 within the edge 713 as is more fully described in reference to FIG. 1B. The storage apparatus 700, can be comprised of a body 702 and a lid 704. The lid 704 may form a seal with the body 702 when they are engaged together. The body 702 may define a body void (not illustrated) as is more fully described in reference to FIG. 1A above.

The lid 704 of the storage apparatus 700 can be comprised of a skirt 708 and a pad 710 as is more fully described in reference to FIG. 1A above. The pad 710 of the lid 704 is defined by rigid plastic as is more fully described in reference to FIG. 1A above. In at least one example, the pad 710 comprises an upward edge 713 that can define a pad void 707 as is more fully described in reference to FIG. 7B below. The pad 710 may be connected to the skirt 708 via a thermoplastic sealing strip 712 as is more fully described in reference to FIG. 1A above.

In at least one example, the thermoplastic sealing strip 712 may be heat welded to the soft thermoplastic material of the skirt 708 using heat welding as is more fully described in reference to FIG. 1A above. In at least one example, the lid 704 forms an outer surface impermeable to liquids as is more fully described in reference to FIG. 1A above. In another example, the skirt 708 can form an outer lip when it closes the body void (not illustrated) and the body 702 can also form an inner lip. The two lips may form a seal as is more fully described in reference to FIG. 1A above.

Figure 7B:
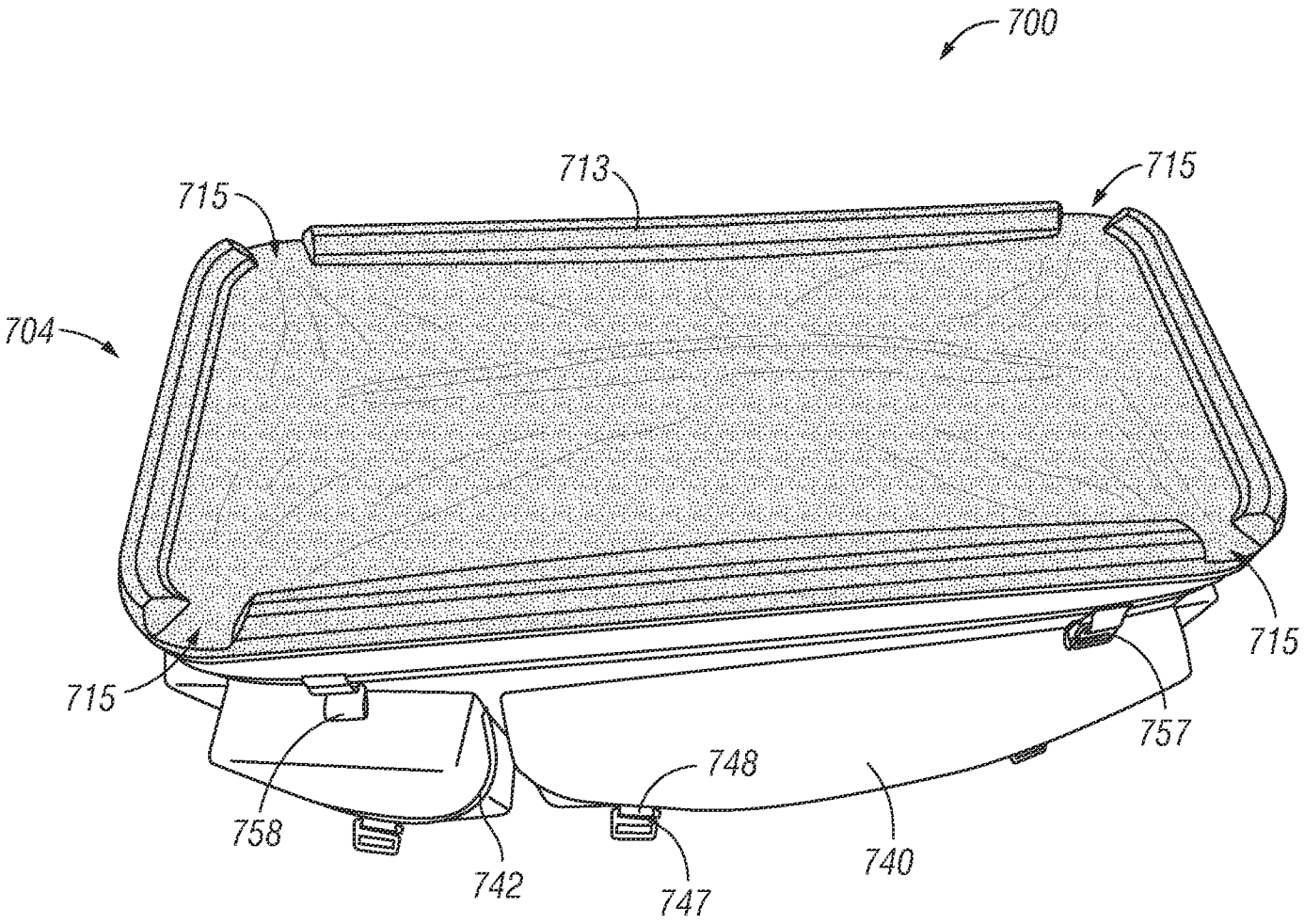
FIG. 7B is an illustration of a top view of a pad containing downward-sloping channels.

FIG. 7B is an illustration of a top view of a pad 710 containing downward-sloping channels 715 within the edge 713 as is more fully described in reference to FIG. 1B above. The storage apparatus 700, can be comprised of a body 702 and a lid 704. In at least one embodiment, the lid 704 forms a seal with the body 702 defining a body void (not illustrated) as is more fully described in reference to FIG. 1A above.

The lid 704 of the storage apparatus 700 can be comprised of a skirt (See FIG. 7A) and a pad 710. The skirt of the lid may be more fully described in reference to FIG. 1A above. The pad 710 of the lid 704 is defined by rigid plastic as is more fully described in reference to FIG. 1A above. In at least one example, the pad 710 comprises an upward edge 713 around the perimeter of the top of the pad 710. This edge 713 provides the benefit of a tray, as mostly flat objects placed on top of the pad 710 will not slide off the pad. The edge 713 can define a pad void 707 that allows for liquid or other materials to be stored. In further examples, the lid 704 forms an outer surface impermeable to liquids as is more fully described in reference to FIG. 1A above.

In at least one embodiment, the lid 704 can be coupled to the body 702 using at least one lid G-Hook fastener 757 and at least one lid webbing loop 758 as is more fully described in reference to FIG. 1C above. It would be understood that where a G-Hook fastener is utilized, magnetic couplings as described herein may also be utilized in place of the G-Hook fastener. The storage apparatus 700 may have at least one pocket 740, webbing loop 748, G-hook fastener 747, and pocket edge covering 742 as is more fully described in reference to FIG. 1A above.

Figure 8:
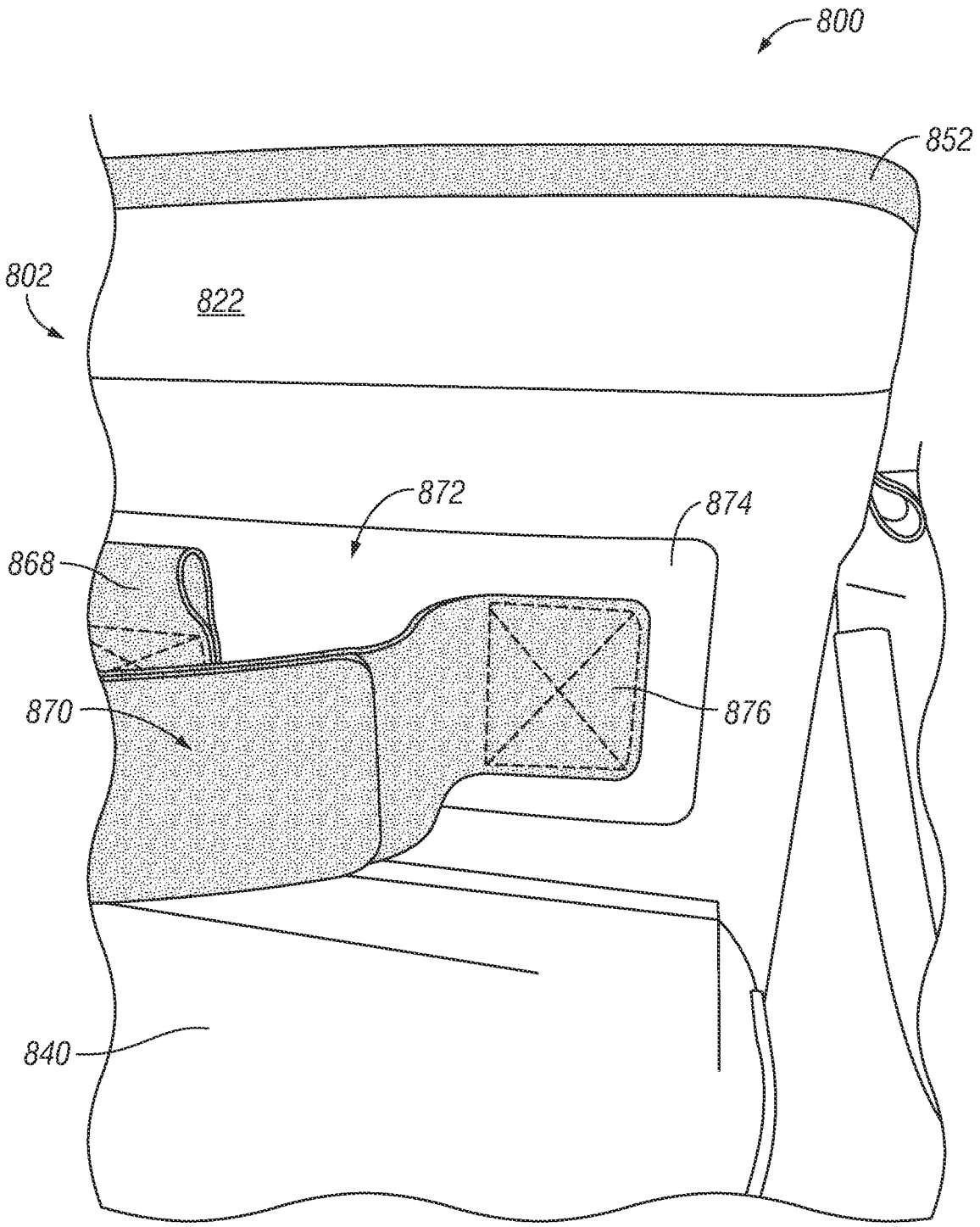
FIG. 8 is an illustration of a close-up side view of a portion of a handle of a storage apparatus.

FIG. 8 is an illustration of a close-up side view of a portion of a handle 870 of a storage apparatus 800. The storage apparatus 800 can be comprised of a body 802 and a lid (See FIG. 1A). The lid (See FIG. 1A) may form a seal with the body 802 when they are engaged together. The body 802 is defined by a front wall (See FIG. 1A), a rear wall (See FIG. 1B), a first side wall 822, a second side wall (See FIG. 1E), and a bottom wall (See FIG. 6A) defining a body void (See FIG. 1A) as is more fully described in reference to FIG. 1A above.

In another example, the lid (See FIG. 1A) can form an outer lip when it closes the body void (See FIG. 1A) and the body 802 can also form an inner lip. The two lips may form a seal as is more fully described in reference to FIG. 1A above. In at least one example, the inner lip may have an inner lip covering 852 as is more fully described in reference to FIG. 4 above. In at least one example, the storage apparatus 800 may have at least one pocket 840 as is more fully described in reference to FIG. 1A above.

In at least one example, the storage apparatus 800 may have at least one handle 870. A handle 870 may be made of materials including, but not limited to, cloth straps, vinyl straps, rope, plastic straps, and/or other similar materials, or combinations thereof. A handle 870 may attach to the lid (See FIG. 1A) or another area of the storage apparatus 800 capable of supporting weight using handle couplers including, but not limited to, stitching, thread, glue, adhesive, or fasteners or combinations thereof. A user may be able to support the weight of the storage apparatus 800 by grasping the handle 870. In at least some examples, the handle 870 may include finger outlines on the handle, indicating preferred regions where a user's fingers may grasp the handle. Other handles on the storage apparatus 800 may also include the finger outlines. In at least one example, the handle 870 may interface with a shoulder strap (See FIG. 10) as to couple the handle 870 and the shoulder strap (See FIG. 10)

together. If coupled, a user may be able to support the weight of the storage apparatus 800 on the user's shoulder via the shoulder strap (See FIG. 10).

In at least one example, the handle 870 is attached to the storage apparatus 800 using stitching via a soft thermoplastic strip 872. In at least one example, the handle 870 is attached to the storage apparatus 800 using heat welding. In at least one example, the soft thermoplastic strip 872 is heat welded to the storage apparatus 800 and is sewn to the handle 870. The edges of the soft thermoplastic strip 874 are heat welded to the storage apparatus 800 and an inner section of the soft thermoplastic strip 806 is sewn to the handle 870. Because the area where the soft thermoplastic strip attaches to the storage apparatus 874 extends beyond the area of the stitching 876, the storage apparatus 800 gains improved liquid resistance properties. Liquids that intrude through the punctures caused by the stitching are still blocked by the outer surface of the storage apparatus 800. The heat welding process also provides liquid resistance along the area where the storage apparatus and the soft thermoplastic strip connect 872. Viewed as a whole, this arrangement of the handle 870, the soft thermoplastic strip 872, and the storage apparatus 800 improve liquid resistance.

In at least one example, a hook side ring (See FIG. 14) connects to the storage apparatus 800 via a hook side ring webbing 879. The hook side ring webbing 879 may comprise a hook side ring webbing loop 868 for securing the shoulder strap (See FIG. 10) as is more fully described in reference to FIG. 14 below.

Figure 9:
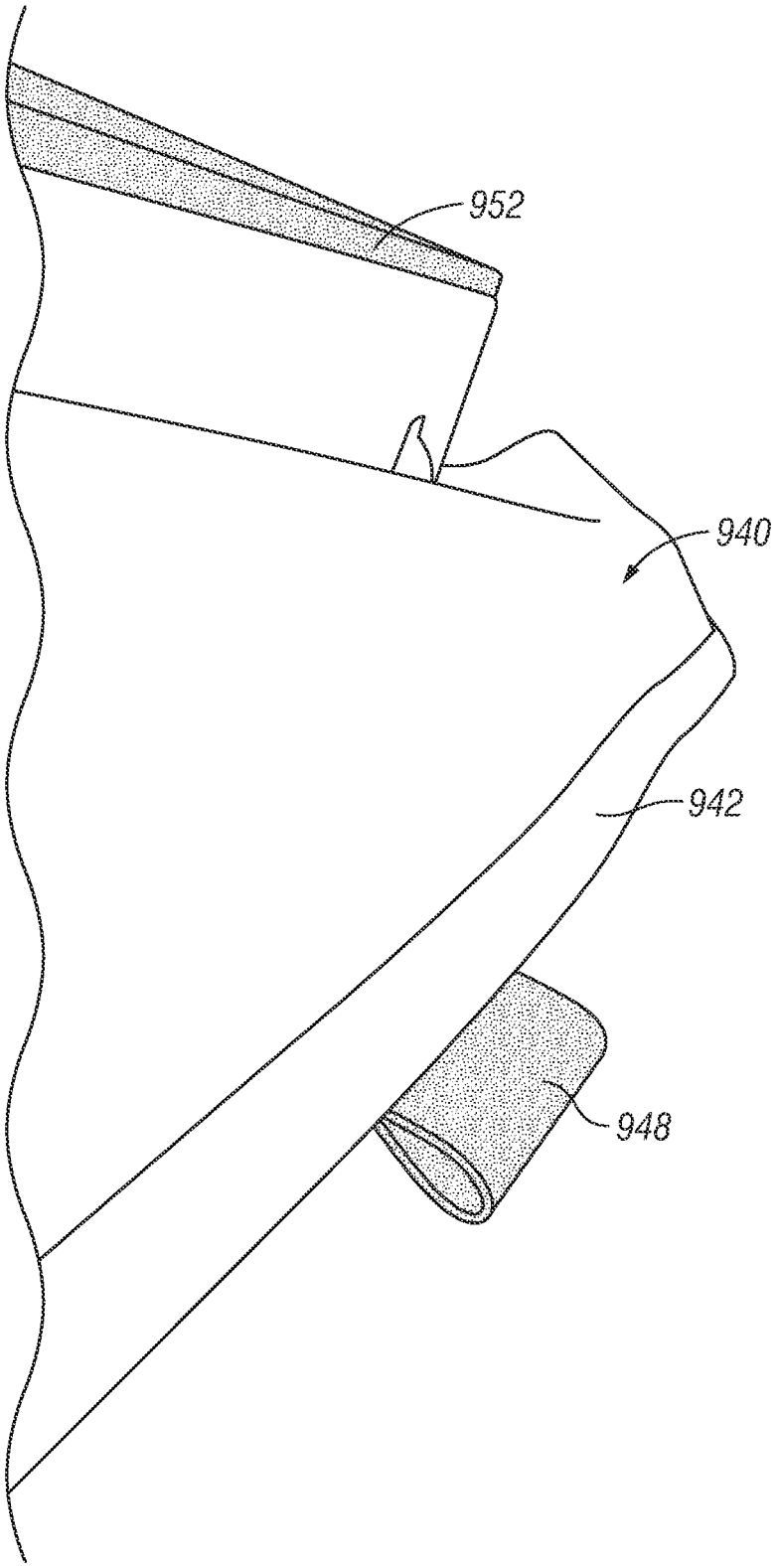
FIG. 9 is an illustration of a close-up side view of at least one pocket of a storage apparatus.

FIG. 9 is an illustration of a close-up side view of an example of at least one pocket 940 of a storage apparatus 900 connected to the outer surface of a body 902 of the storage apparatus 900. The storage apparatus 900 comprises a body 902 and a lid (See FIG. 1A). The body 902 defines a body void (See FIG. 1A) which the lid (See FIG. 1A) closes. In at least one example, the lid (See FIG. 1A) can form an outer lip when it closes the body void (See FIG. 1A) and the body 902 can also form an inner lip. The two lips may form a seal as is more fully described in reference to FIG. 1A above. In at least one example, the inner lip may have an inner lip covering 952 as is more fully described in reference to FIG. 4 above.

In at least one example, the storage apparatus 900 may have at least one pocket 940, webbing loop 948, G-hook fastener (See FIG. 1A), and pocket edge covering 942 as is more fully described in reference to FIG. 1A above. It would be understood that where a G-Hook fastener is utilized, magnetic couplings as described herein may also be utilized in place of the G-Hook fastener. The pocket edge covering 942 may be made of a flexible or fabric like material including, but not limited to, cloth, vinyl, canvas, metal, plastic, or other similar materials and/or combinations thereof. The pocket edge covering 942 may attach to the pocket 940 using a plurality of pocket hook couplers including, but not limited to, stitching, thread, glue, adhesive, or fasteners and/or connections or combinations thereof.

Figure 10:
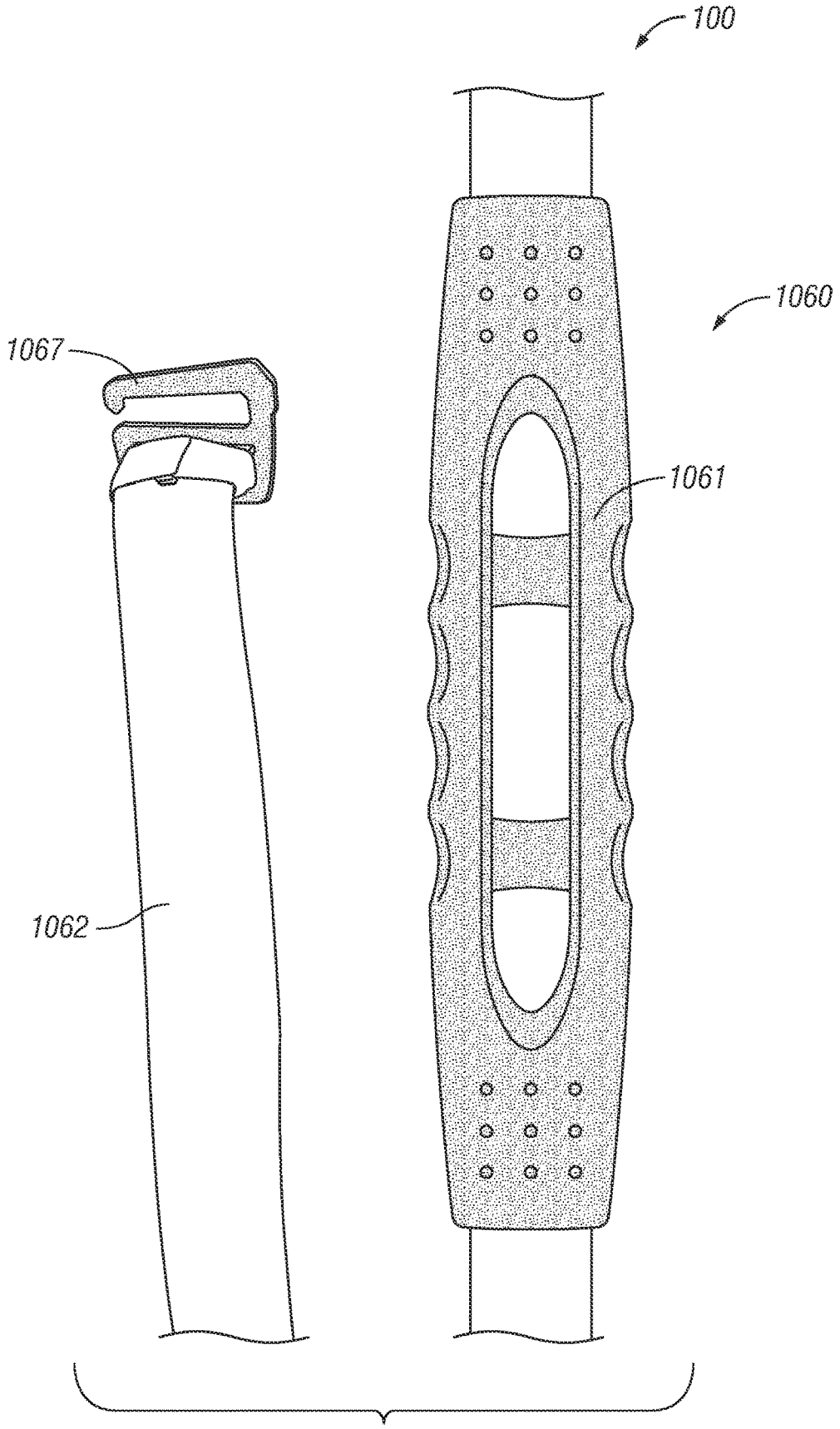
FIG. 10 is an illustration of a portion of a shoulder strap.

FIG. 10 is an illustration of a portion of a shoulder stap 1060. The storage apparatus 1000, can be comprised of a body (See FIG. 1A) and a lid (See FIG. 1A). In at least one example, the lid (See FIG. 1A) forms a seal with the body (See FIG. 1A) when they are engaged together. The body (See FIG. 1A) is defined by a front wall (See FIG. 1A), a rear wall (See FIG. 1B), a first side wall (See FIG. 1A), a second side wall (See FIG. 1E), and a bottom wall (See FIG. 6A) defining a body void (See FIG. 1A) as is more fully described in reference to FIG. 1A above.

In at least one example, the shoulder strap 1060 comprises a shoulder strap G-Hook fastener 1067 and a shoulder strap webbing 1062. It would be understood that where a G-Hook fastener is utilized, magnetic couplings as described herein may also be utilized in place of the G-Hook fastener. It is within the scope of the present disclosure for the shoulder strap 1060 to be attached to at least one point along the front wall (See FIG. 1A), the rear wall (See FIG. 1B), first side wall (See FIG. 1A), the second side wall (See FIG. 1E), and/or a bottom wall (See FIG. 6A) of the body, the lid, and/or other similar areas of the storage apparatus 1000 capable of supporting weight using a plurality of couplings including, but not limited to, stitching, thread, glue, adhesive, hook and loop, button and slot, snaps, or fasteners and/or connections or combinations thereof. Shoulder strap 1060 may be constructed utilizing materials such as, but not limited to, cloth, vinyl, rope, plastic, and/or other similar materials. The shoulder strap 1060 allows a user to transport the storage apparatus 1000 more easily by supporting the weight of the apparatus on the user's shoulder via the shoulder strap 1060.

In at least one example, the shoulder strap 1060 comprises a shoulder strap grip 1061. The shoulder strap grip 1061 may be made of a solid material including, but not limited to, plastic, metal, or similar materials and/or combinations thereof. In other examples, the shoulder strap grip 1061 may be made of a flexible or fabric like material including, but not limited to, cloth, vinyl, canvas, metal, plastic, or other similar materials and/or combinations thereof. In at least some examples, the shoulder strap grip 1061 may include finger outlines on the grip, indicating preferred regions where a user's fingers may grasp the grip. Other handles on the storage apparatus 1000 may also include the finger outlines.

Figure 11:
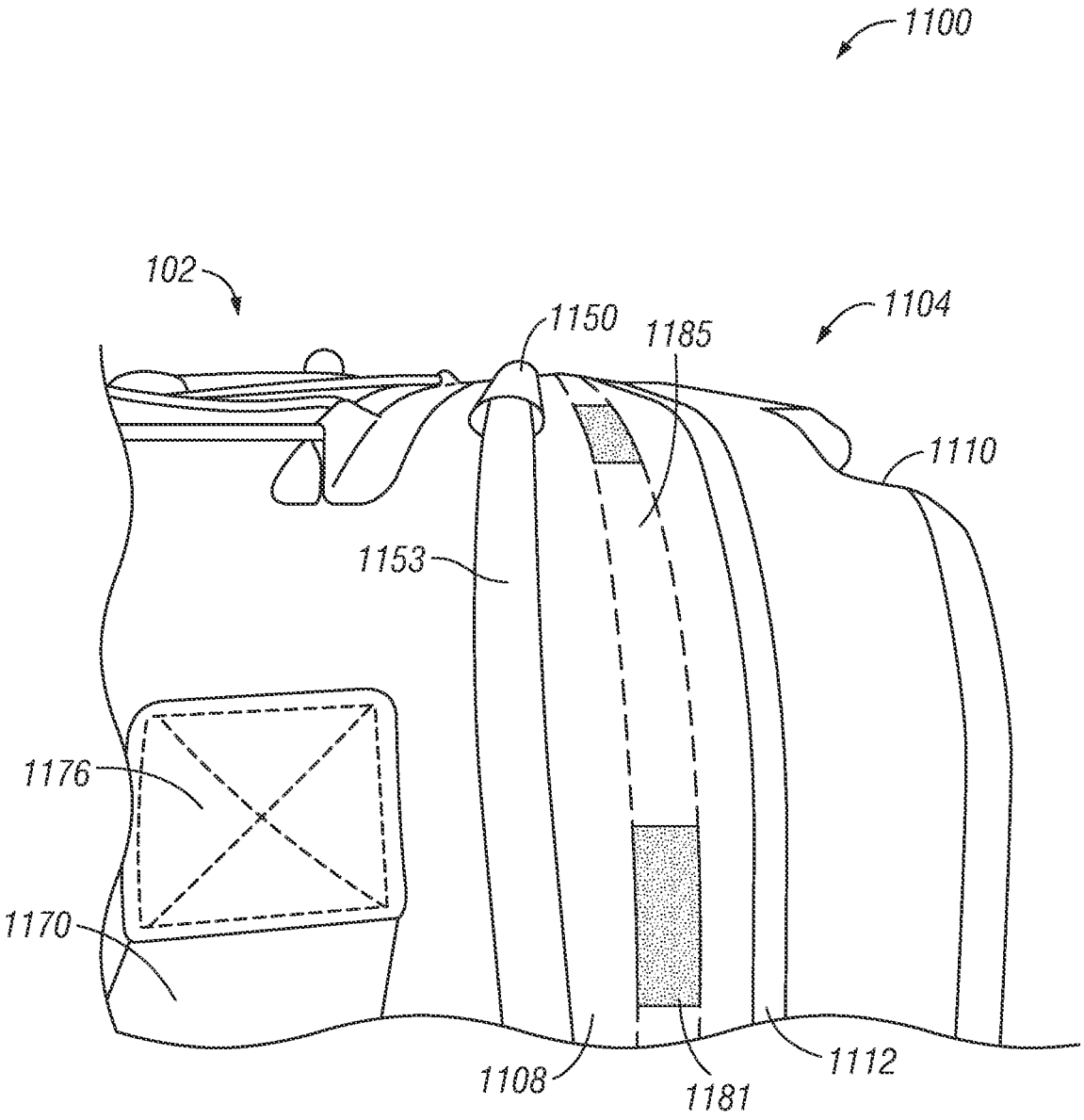
FIG. 11 is an illustration of a close-up view of a back hinge of a storage apparatus.

FIG. 11 is an illustration of a close-up view of a back hinge 1150 of a storage apparatus 1100. The storage apparatus 1100, can be comprised of a body 1102 and a lid 1104. In at least one example, the lid 1104 forms a seal with the body 1102 when they are engaged together. The body 1102 may define a body void (See FIG. 1A) as is more fully described in reference to FIG. 1A above.

In some examples, the disconnecting hinge can comprise snaps or a zipper. In yet other examples, the lid is connected to the body via a back hinge 1150. The lid 1104 or the body 1102 and the securing mechanism can be coupled together through a stitching or other connection type such as glue, magnets, buttons, snaps, or a combination thereof, or other connection types.

The lid 1104 of the storage apparatus 1100 can be comprised of a skirt 1108 and a pad 1110 as is more fully described in reference to FIG. 1A above. In at least one example, the lid 1104 forms a seal with the body 1102 when they are engaged together. The pad 1110 of the lid 1104 is defined by rigid plastic as is more fully described in reference to FIG. 1A above. The pad 1110 may be connected to the skirt 1108 via a thermoplastic sealing strip 1112 as is more fully described in reference to FIG. 1A above.

In at least one embodiment, the thermoplastic sealing strip 1112 may be heat welded to the soft thermoplastic material of the skirt 1108 using heat welding as is more fully described in reference to FIG. 1A above. In at least one example, the lid 1104 forms an outer surface impermeable to liquids as is more fully described in reference to FIG. 1A above. In another example, the skirt 1108 can form an outer lip when it closes the body void (See FIG. 1A) and the body 1102 can also form an inner lip. The two lips may form a seal as is more fully described in reference to FIG. 1A above. In further examples, at least one handle 1170 may be attached to a storage apparatus 1100 via a soft thermoplastic strip (See FIG. 1A). The soft thermoplastic strip comprises edges of the soft thermoplastic strip (See FIG. 1A) and an area of stitching 1176 as is more fully described in reference to FIG. 8 above.

In at least one example, at least one magnet (See FIG. 3) is enclosed within the body 1102 in a first strip (See FIG. 3)) and at least one magnet 1181 is enclosed within the skirt 1108 in a second strip 1185 as is more fully described in reference to FIG. 3 above. The rear (See FIG. 1B) of the storage apparatus 1100, in at least one example, can include additional storage straps 1144 as is more fully described in reference to FIG. 1B above.

In at least one example, the back hinge 1150 may act as a securing mechanism to connect the lid 1104 to the body 1102. The back hinge 1150 may be a plurality of materials including, but not limited to, cloth, vinyl, canvas, metal, plastic, or other similar materials and/or combinations thereof. At least one portion of the back hinge 1150 may attach to the top edges of the rear wall of the body (See FIG. 1B) and a second portion of the back hinge 1150 may attach to the bottom edges of the lid 1104 using a plurality of hinge couplers including, but not limited to, stitching, thread, glue, adhesive, hook and loop, button and slot, snaps, or fasteners and/or connections or combinations thereof. The back hinge 1150 may attach permanently or temporarily to the rear wall of the body 1100.

Figure 12:
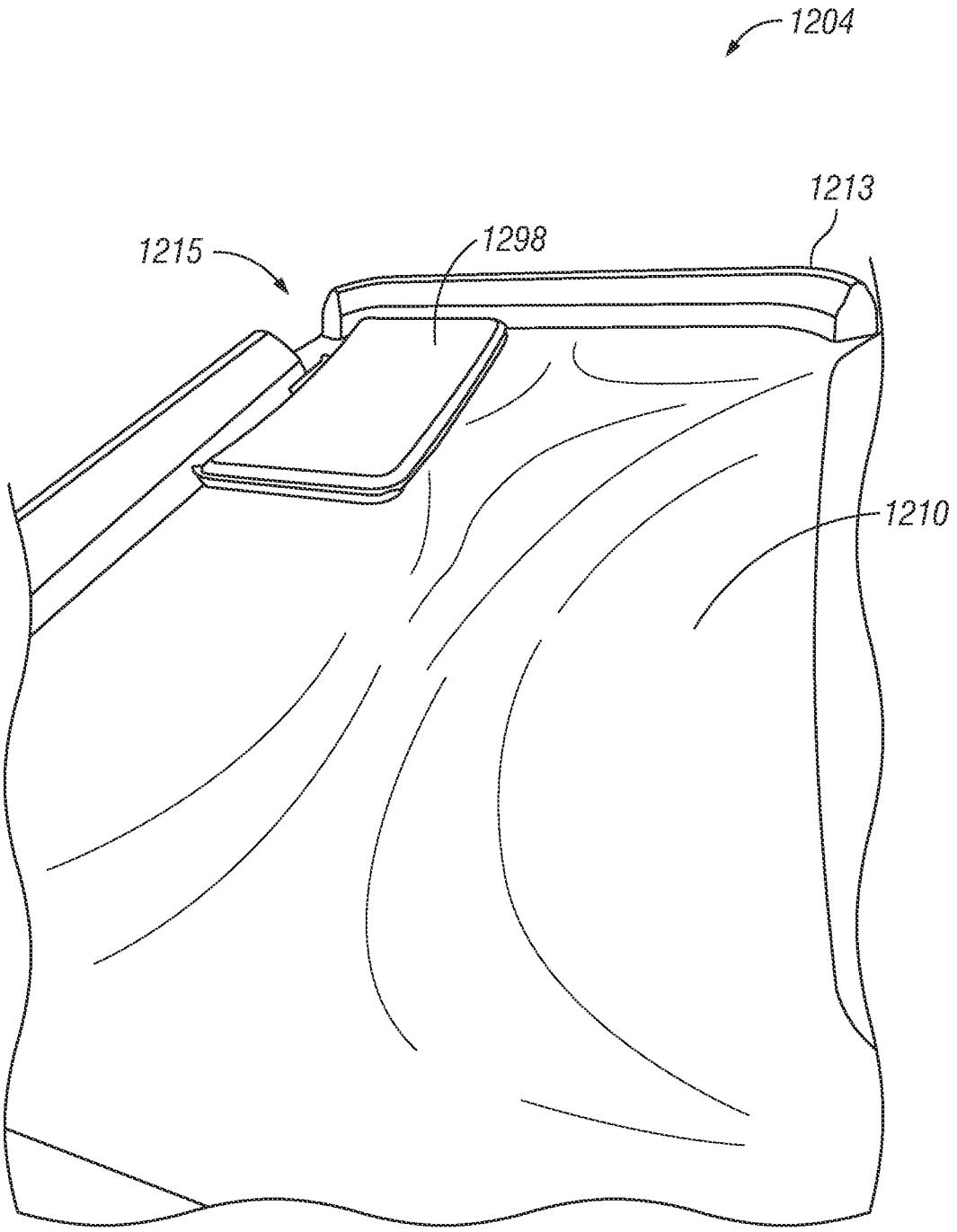
FIG. 12 is an illustration of a lid of a storage apparatus with a decking material.

FIG. 12 is an illustration of a lid 1204 of a storage apparatus 1200 with a decking material 1250. The lid 1204 of the storage apparatus 1200 can be comprised of a pad 1210. The pad 1210 of the lid 1204 is defined by rigid plastic as is more fully described in reference to FIG. 1A above. In at least one example, the pad 1210 comprises an upward edge 1213 that can define a pad void 1207 as is more fully described in reference to FIG. 7B above. In at least one example, the pad 1210 contains downward-sloping channels 1215 within the edge 1213 as is more fully described in reference to FIG. 1B above.

In at least one embodiment, the decking material 1298 may be a plurality of materials including, but not limited to, cloth, vinyl, canvas, metal, plastic, or other similar materials and/or combinations thereof. In other examples, the decking material 1298 may be a combination of polyethylene and ethylene vinyl acetate (PE/EVA) foam. In further examples, the decking material 1298 may have three layers of material. In yet further examples, the decking material 1298 is multilayer PE/EVA material having grooves or markings throughout. In yet some other examples, the decking material 1298 is a multi-layer surface covering including at least a first and a second layer made off a polyvinyl chloride material, each of the two layers having a different density. The bottom surface of the decking material 1298 may attach to the top surface of the pad 1210 of the lid 1204 using a plurality of securing means including, but not limited to, stitching, thread, glue, adhesive, hook and loop, button and slot, snaps, or fasteners and/or connections or combinations thereof.

Figure 13A:
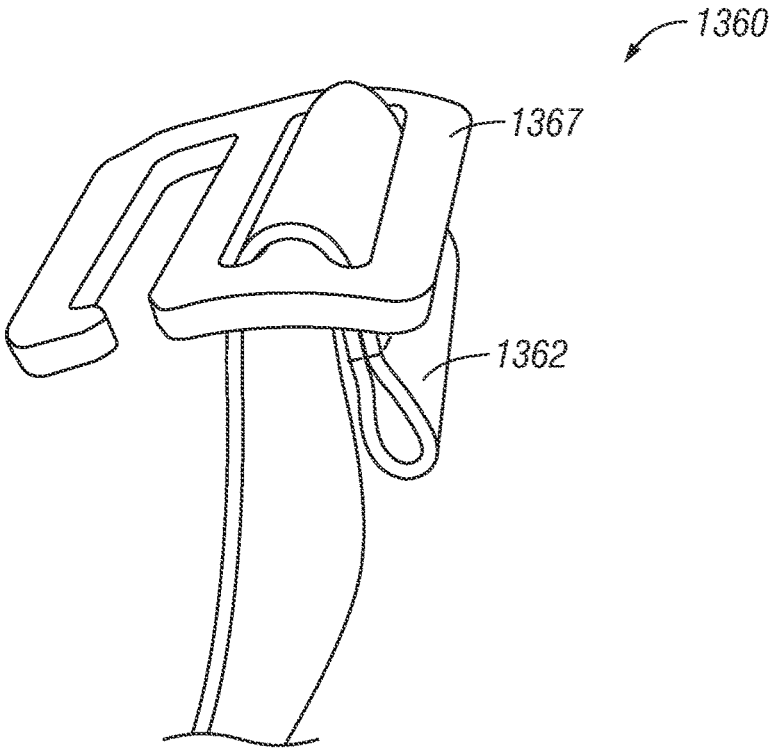
FIG. 13A is an illustration of a close-up side view of a shoulder strap G-hook fastener and webbing of a storage apparatus.
Figure 13B:
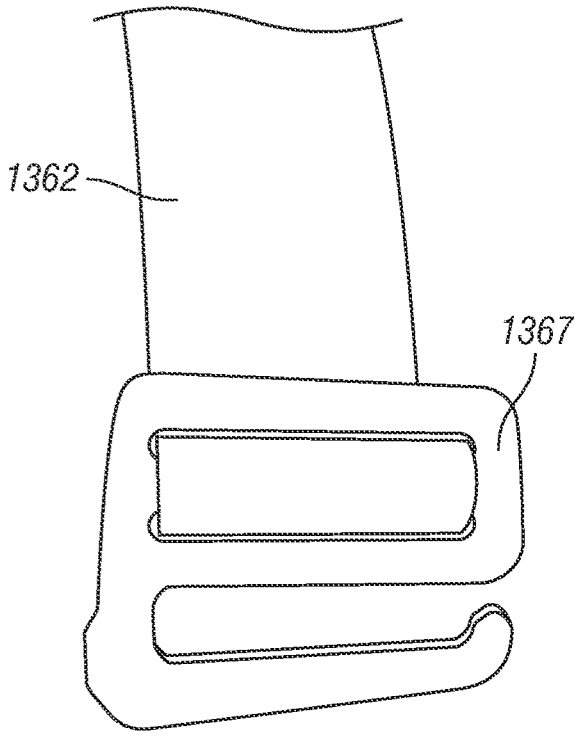
FIG. 13B is an illustration of a close-up front view of a shoulder strap G-hook fastener and webbing of a storage apparatus.

FIG. 13A is an illustration of a close-up side view of a shoulder strap G-hook fastener 1367 and webbing 1362 of a storage apparatus 1300. FIG. 13B is an illustration of a close-up front view of an example of a shoulder strap G-hook fastener 1367 and webbing 1362 of a storage apparatus 1300 as is more fully described in reference to FIG. 13A above. It would be understood that where a G-Hook fastener is utilized, magnetic couplings as described herein may also be utilized in place of the G-Hook fastener.

Figure 13C:
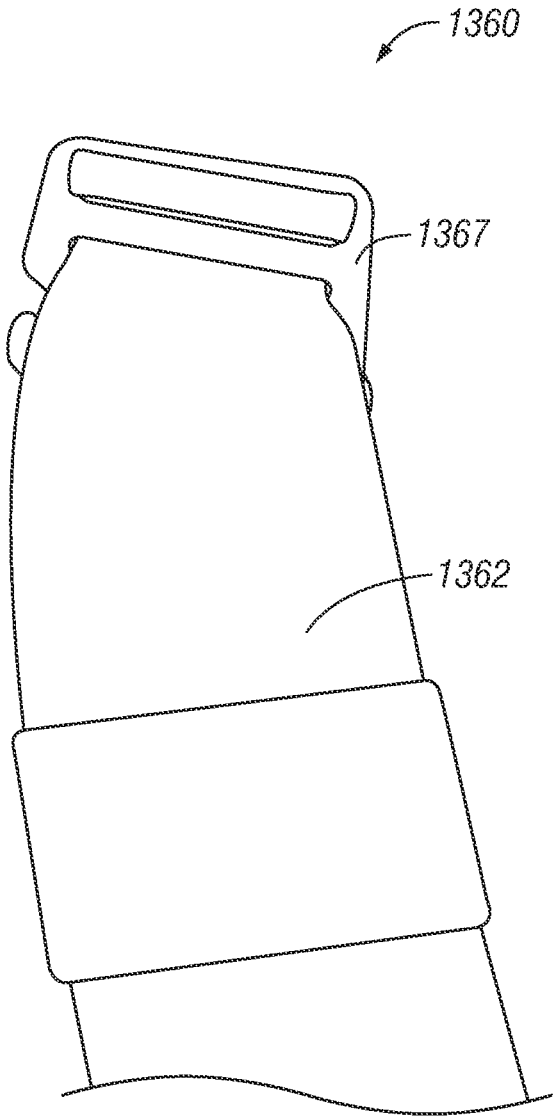
FIG. 13C is an illustration of a close-up rear view of a shoulder strap G-hook fastener and webbing of a storage apparatus.

FIG. 13C is an illustration of a close-up rear view of a shoulder strap G-hook fastener 1367 and webbing 1364 of a storage apparatus 1300 as is more fully described in reference to FIG. 13A above.

In at least one example, the shoulder strap G-Hook fastener 1367 may be a hook fastener made of a solid material including, but not limited to, plastic, metal, or similar materials and/or combinations thereof. The shoulder strap webbing 1362 may be made of a flexible or fabric like material including, but not limited to, cloth, vinyl, canvas, metal, plastic, or other similar materials and/or combinations thereof. In at least one example, the shoulder strap G-hook fastener 1367 comprises a pass-through loop 1369, a connecting void 1366, and a hook lip 1363. The pass-through loop 1369 comprises a surface with two voids for securing the shoulder strap webbing 1362. The hook lip 1363 extends peripherally from the surface and envelops the connecting void 1366. The hook lip 1363 gradually shrinks in width as it extends from the surface, jutting back towards the surface and forming a narrow end at the tip of the hook lip 1363. In at least one example, the shoulder strap G-hook fastener 1367 is slightly concaved.

Figure 14:
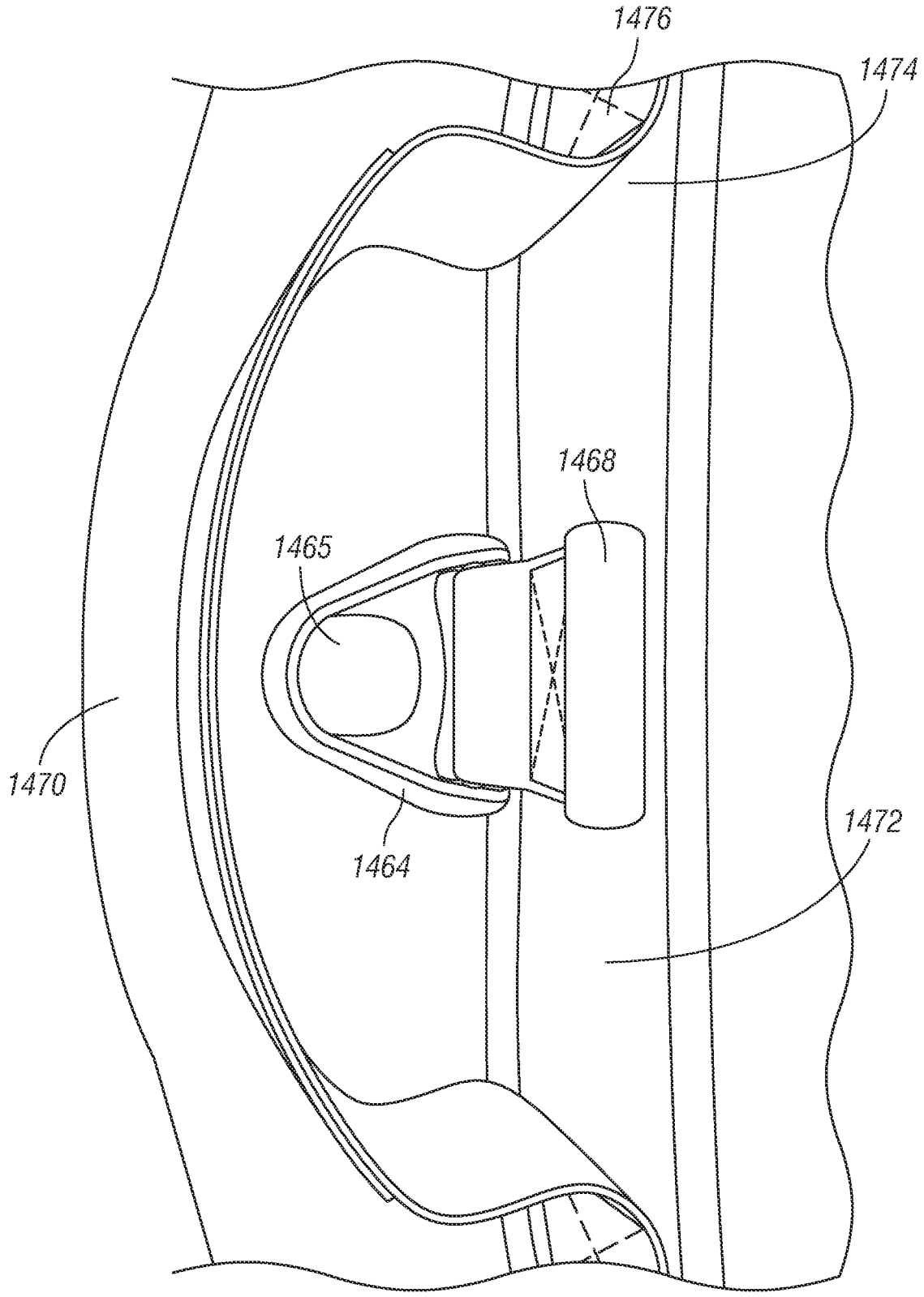
FIG. 14 is an illustration of a top view of a hook side ring of a storage apparatus.

FIG. 14 is an illustration of a top view of a hook side ring 1464 of a storage apparatus 1400. In at least one example, at least one handle 1470 may be attached to a storage apparatus 1400 via a soft thermoplastic strip 1472. The soft thermoplastic strip comprises edges of the soft thermoplastic strip 1474 and an area of stitching 1476 as is more fully described in reference to FIG. 8 above.

In at least one example, a hook side ring 1464 connects to the storage apparatus 1400 via a hook side ring webbing 1479. In at least one example, the hook side ring webbing 1479 may comprise a hook side ring webbing loop 1468 for securing the shoulder strap G-Hook fastener (See FIG. 10) of the shoulder strap (See FIG. 10). It would be understood that where a G-Hook fastener is utilized, magnetic couplings as described herein may also be utilized in place of the G-Hook fastener. The hook side ring 1464, which comprises a hook side ring void 1465, may be a ring made of a solid material including, but not limited to, plastic, metal, or similar materials and/or combinations thereof. The hook side ring webbing 1479 may be made of a flexible or fabric like material including, but not limited to, cloth, vinyl, canvas, metal, plastic, or other similar materials and/or combinations thereof. The hook side ring 1464 may interface with a shoulder strap (See FIG. 10) as to couple the hook side ring 1464 and the shoulder strap (See FIG. 10) together. If coupled, a user may be able to support the weight of the storage apparatus 1400 on the user's shoulder via the shoulder strap 1460. The hook side ring 1464 offers flexibility to attach smaller storage containers to the outside of the storage apparatus 1400. Additionally, the hook side ring 1464 may be used to secure the storage apparatus 1400 to a fixed position. This is a desired feature in situations where the storage apparatus 1400 may unexpectedly change position, such as aboard a vessel in turbulent weather conditions.

FIG. 15 is an illustration of a close-up view of welded loops of a storage apparatus 1500. The storage apparatus comprises a body (See FIG. 1A) that can have one or more pockets coupled to it. In at least one example, the storage apparatus 1500 may have at least one pocket 1540, webbing loop 1548, G-hook fastener (See FIG. 1A), and pocket edge covering 1542 as is more fully described in reference to FIG. 1A above. It would be understood that where a G-Hook fastener is utilized, magnetic couplings as described herein may also be utilized in place of the G-Hook fastener.

The pocket edge covering 1542 may be made of a flexible or fabric like material including, but not limited to, cloth, vinyl, canvas, metal, plastic, or other similar materials and/or combinations thereof. The pocket edge covering 1542 may attach to the pocket 1540 using a plurality of pocket hook couplers including, but not limited to, stitching, thread, glue, adhesive, or fasteners and/or connections or combinations thereof.

In at least one example, the pocket webbing loop 1548 may attach to the pocket 1540 using a plurality of pocket loop couplers including, but not limited to, stitching, thread, glue, adhesive, or fasteners and/or connections or combinations thereof. The at least one pocket webbing loop 1548 may attach to the pocket 1540 via stitching onto the pocket edge covering 1542.

It will be understood by those skilled in the art that various changes to this invention in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

While various examples in accordance with the principles disclosed herein have been described above, it should be understood that they have been presented by way of example only, and not limitation. Thus, the breadth and scope of this disclosure should not be limited by any of the above-described examples, but should be defined only in accordance with any claims and their equivalents issuing from this disclosure. Furthermore, the above advantages and features are provided in described examples, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any example(s) in this disclosure. Neither is the "Brief Summary of the Invention" to be considered as a characterization of the example(s) set forth in issued claims. Furthermore, any reference in this disclosure to "invention" in the singular should not be used to argue that there is only a single point of novelty in this disclosure. Multiple examples may be set forth according to the limitations of the multiple claims issuing from this disclosure, and such claims accordingly define the example (s), and their equivalents, that are protected thereby. In all instances, the scope of such claims shall be considered on their own merits in light of this disclosure, but should not be constrained by the headings set forth herein.

We claim:

1. A storage apparatus comprising:

a body defining a body void;

a lid that closes the body void having a skirt and a pad, the lid configured to be friction fit with the body and the body void when closed;

wherein the skirt is defined by a front wall, a rear wall, and opposing skirt side walls connecting the front wall to the rear wall, wherein the skirt front, rear, and side walls each comprise soft thermoplastic and the skirt overlaps the outer edge of the body; and wherein the pad is defined by rigid plastic connected to top edges of the skirt front, rear, and side walls via a thermoplastic sealing strip heat welded to the top edges of the skirt front, rear, and side walls, and sewn to bottom edges of the pad; wherein the pad further comprises an edge extending upward from the pad, and the edge having at least one channel through it allowing for drainage.

2. The storage apparatus of claim 1, wherein the lid forms an outer surface impermeable to liquids.

3. The storage apparatus of claim 1, wherein the skirt forms an outer lip and the body forms an inner lip when the lid closes the body void forming a seal.

4. The storage apparatus of claim 3, further comprising:

at least one magnet enclosed within the skirt; and at least one magnet enclosed within the body positioned to magnetically adhere with the at least one magnet enclosed within the skirt.

5. The storage apparatus of claim 4, wherein the seal is strengthened by adhering the at least one enclosed magnet within the skirt to the at least one enclosed magnet within the body.

6. The storage apparatus of claim 5, wherein the bottom edges of the pad further comprise a disposed lip projecting around a perimeter of the pad.

7. The storage apparatus of claim 1, wherein the body is defined by a front wall, a rear wall, a first side wall, a second side wall, and a bottom wall, wherein the body front, rear, and side walls each comprise soft thermoplastic.

8. The storage apparatus of claim 7, wherein the soft thermoplastic comprises thermoplastic polyurethane (TPU).

9. The storage apparatus of claim 7, wherein the rigid plastic comprises acrylonitrile butadiene styrene (ABS).

10. The storage apparatus of claim 3, further comprising:

a first strip enclosed in the area that forms the inner lip, wherein the first strip has at least one embedded magnet; and a second strip enclosed in the area that forms the outer lip, wherein the second strip has at least one embedded magnet positioned to magnetically adhere with the at least one embedded magnet in the first strip within the skirt.

11. The storage apparatus of claim 10, wherein the at least one magnet in the inner lip magnetically adheres with the at least one magnet in the outer lip when the lid closes the body void.

12. A method of manufacture of a lid comprising:

providing a skirt comprising a front wall, a rear wall, and opposing skirt side walls connecting the skirt front wall to the skirt rear wall, wherein the skirt front, rear and side walls comprise soft thermoplastic;

forming a pad comprising rigid plastic for connecting to the skirt;

connecting bottom edges of the pad to top edges of the skirt front, rear and side walls using a thermoplastic sealing strip by:

heat welding a first edge of the thermoplastic sealing strip to the top edges of the skirt front, rear, and side walls;

sewing a second edge of the thermoplastic sealing strip to the bottom edges of the pad; and sealing a body with the lid by enveloping the outer edge of the body with the lid and the skirt, the body defined by a front wall, a rear wall, a first side wall, a second side wall, and a bottom wall, wherein the lid configured to be friction fit with the body when closed.

13. The method of claim 12, wherein the skirt connecting to the pad forms an outer surface impermeable to liquids; and wherein the pad further comprises an edge extending upward from the pad, and the edge having at least one channel through it allowing for drainage.

14. The method of claim 12, wherein the skirt further comprises at least one magnet.

15. The method of claim 12, wherein the soft thermoplastic comprises thermoplastic polyurethane (TPU).

16. The method of claim 12, wherein the rigid plastic comprises acrylonitrile butadiene styrene (ABS).

17. The method of claim 12, further comprising:

heat welding an inner lip covering to top edges of the body; and heat welding an outer lip covering to bottom edges of the lid.

18. The method of claim 12, wherein the skirt further comprises at least one magnet enclosed within the skirt, and the body further comprises at least one magnet enclosed within the body positioned to magnetically adhere with the at least one magnet enclosed within the skirt when the lid closes the body.

19. The method of claim 18, further comprising sealing the body with the lid by adhering the at least one magnet enclosed within the skirt to the at least one magnet enclosed within the body.

20. A storage system comprising:

at least one dividing wall defining a wall, a first edge, and a second edge;

a storage apparatus configured to removably couple the at least one dividing wall, wherein the storage apparatus further comprises a body defining a body void, and a lid that closes the body void having a skirt and a pad;

wherein each dividing wall edge couples to opposing sides of the body void by a securing mechanism;

wherein the skirt is defined by a front wall, a rear wall, and opposing skirt side walls connecting the front wall to the rear wall, wherein the skirt front, rear, and side walls each comprise soft thermoplastic and the skirt fits along the outer edge of the body; and wherein the pad is defined by rigid plastic connected to top edges of the skirt front, rear, and side walls via a thermoplastic sealing strip heat welded to the top edges of the skirt front, rear, and side walls, and sewn to bottom edges of the pad;

wherein the pad further comprises an edge extending upward from the pad, and the edge has at least one channel through it allowing for drainage;

wherein the lid is configured to be friction fit with the body and the body void when closed.

* * * * *